US006175351B1

(12) United States Patent
Matsuura et al.

(10) Patent No.: US 6,175,351 B1
(45) Date of Patent: Jan. 16, 2001

(54) IMAGE DISPLAY APPARATUS AND A METHOD FOR DRIVING THE SAME

(75) Inventors: Manabu Matsuura, Tenri; Hiroshi Yoneda, Ikoma; Yoshitaka Yamamoto, Yamatokoriyama; Yutaka Ishii, Nara; Shigeto Yoshida, Tenri, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 08/959,530

(22) Filed: Oct. 24, 1997

Related U.S. Application Data

(63) Continuation of application No. 08/287,881, filed on Aug. 9, 1994, now abandoned.

(30) Foreign Application Priority Data

Aug. 10, 1993 (JP) ..... 5-198636
Sep. 22, 1993 (JP) ..... 5-236609

(51) Int. Cl.[7] ..... G09G 3/36
(52) U.S. Cl. ..... 345/98
(58) Field of Search ..... 345/98, 100, 129, 345/130; 348/790–793

(56) References Cited

U.S. PATENT DOCUMENTS

| | | |
|---|---|---|
| 4,432,610 | 2/1984 | Kobayashi et al. . |
| 4,532,506 | 7/1985 | Kitazima et al. . |
| 4,781,437 | 11/1988 | Shields et al. . |
| 4,829,453 | 5/1989 | Katsuta et al. . |
| 4,870,396 | 9/1989 | Shields . |
| 5,040,874 | 8/1991 | Fukuda et al. . |
| 5,111,119 | 5/1992 | Fukuoka et al. . |
| 5,119,084 | 6/1992 | Kawamura et al. . |
| 5,165,075 | 11/1992 | Hiroki et al. . |
| 5,194,974 | 3/1993 | Hamada et al. . |
| 5,227,882 | 7/1993 | Kato . |
| 5,301,031 | 4/1994 | Eto et al. . |
| 5,359,343 | 10/1994 | Nakamura . |
| 5,365,284 | 11/1994 | Matsumoto et al. . |

FOREIGN PATENT DOCUMENTS

| | | |
|---|---|---|
| 64-5282 | 1/1989 | (JP) . |
| 3-257427 | 11/1991 | (JP) . |
| 4-310925 | 11/1992 | (JP) . |

OTHER PUBLICATIONS

Marha, "Pulsed Electric and Magnetic Fields could be More Harmful Than Nonplused Fields", MACWORLD, Jul. 1990., pp. 140–141.

Alhbom et al, "Swedish Officials Acknowledge EMF–Cancer Connection", 1992 MICROWAVE NEWS, p.2–4 Mg.

Herbert Taub and Donald Schilling, "Digital Integrated Electronics", 1977, McGraw Hill, p. 451.

*Primary Examiner*—Amare Mengistu
(74) *Attorney, Agent, or Firm*—Nixon & Vanderhye P.C.

(57) ABSTRACT

The image display apparatus of the present invention including a display device having a plurality of pixels arranged in a matrix and driven by a field sequential scanning system, includes: a display driving circuit for supplying a display signal to each of the pixels; a scanning circuit for supplying a scanning signal to each of the pixels, the scanning circuit allowing the pixel to receive a charge corresponding to the display signal during a predetermined write time; and a write time modulation circuit for modulating the write time of the pixel according to the progress of the scanning by the scanning circuit.

13 Claims, 26 Drawing Sheets

IMAGE DISPLAY APPARATUS AND A METHOD FOR DRIVING THE SAME

This is a continuation of application Ser. No. 08/287,881, filed Aug. 9, 1994, now abandoned.

BACKGROUND OF THE INVENTION

1. Field of the Invention

The present invention relates to an image display apparatus of an active driving system and a method for driving the same. More specifically, the present invention relates to an image display apparatus where the scanning is effected by a field sequential scanning system and a method for driving the same.

2. Description of the Related Art

In recent years, brighter and higher quality image displays have been requested for various types of image display apparatuses such as a liquid crystal display (hereinafter, referred to as an LCD) apparatus. At the same time, with the increasing demand for portable information apparatuses, smaller and lighter image display apparatuses have been required.

Before describing conventional image display apparatuses, the terms "field" and "frame" as used herein are clarified as follows.

Frame: An image corresponding to the entire screen of an image display apparatus Field: a component of the "frame"

In linear sequential scanning, display image data for one field is output by scanning a screen once from the top to the bottom thereof. One field period is defined as that period of time starting from when the scanning is initiated at the top end of the screen until the scanning returns to the top end again after the completion of the scanning at the bottom end of the screen. When interlaced scanning is used, one frame image is obtained by two fields. When non-interlaced scanning is used, one frame image is obtained by one field.

With the above definition, when an input interlaced signal is divided into three signals, red (R), green (G), and blue (B), and scannings are separately conducted for these signals sequentially, six fields are required to complete one frame image. Hereinafter, the field and the frame as used for normal TV signals of the NTSC system and the like are described. Such a field and a frame are hereinafter referred to as a TV field and a TV frame. When interlaced, one TV frame is obtained by two TV fields, completing one picture. One TV field is approximately 16.7 msec (60 Hz) in the case of an NTSC (M) signal, while it is 20 msec (50 Hz) in the case of a PAL·SECAM (B/G/D/K/I/L) signal.

A conventional active matrix LCD apparatus driven by the field sequential scanning system is shown in FIG. 23. This type of display apparatus is described, for example, in Japanese Laid-Open Patent Publication No. 64-5282. A display apparatus 18 shown in FIG. 23 is a color LCD apparatus. In the display apparatus 18, color video signals are supplied to data input terminals 10R, 10G, and 10B as red (R), green (G), and blue (B) image data, respectively. The display apparatus 18 includes A/D converters 20 for converting analog signals supplied as image data into digital signals, a memory 21 composed of a plurality of memory elements for storing data, a memory selection circuit 22, D/A converters 23 for converting the digital signals to analog signals for display, a data transfer circuit 24, a data scanning circuit 25, a control circuit 26 for controlling various circuits, and a pixel display portion 27. Two memory elements of the memory 21 are allocated for each color so as to complete a double frame memory for storing the image data of one frame and that of the next frame.

The A/D converters 20 and the D/A converters 23 are implemented by A/D conversion ICs (integrated circuits) and D/A conversion ICs, respectively. The memory 21 is implemented by memory elements such as DRAMs (Dynamic Random Access Memories), SRAMs (Static Random Access Memories), ROMs (Read Only Memories), and the like. Also, the data transfer circuit 24 and the data scanning circuit 25 are generally implemented by ICs called a source driver and a gate driver, respectively.

The display apparatus 18 effects color display by dividing the cycle of input image data (a vertical scanning period) into three equal portions. In other words, each of the R, G, and B signals stored in the memory 21 is selectively output from the memory selection circuit 22 one at a time at a cycle one-third that of the input image data. Therefore, the frequency of the signals for display is three times that of the input data signals.

FIG. 24 is an equivalent circuit of a pixel of the conventional display apparatus 18. The display apparatus 18 includes pixels arranged in a matrix, and signal lines 5 and scanning lines 6 for supplying data signals and scanning signals to the pixels, respectively. Each of the pixels includes a driving element (switching element) 3 composed of a thin film transistor (TFT), a liquid crystal (LC) capacitance 1 (capacitance value $C_p$), and an auxiliary capacitance 8 (capacitance value $C_s$). A signal line 5 is connected to one of electrodes of the LC capacitance 1 through drain/source terminals of the TFT 3, and a scanning line 6 is connected to a gate terminal of the TFT 3.

In such a pixel, the LC capacitance 1 is composed of two electrodes and liquid crystal sandwiched by the two electrodes. One of the electrodes (pixel electrode) is connected to the driving element 3, while the other electrode (common electrode) is connected to a common electric source line 7. The scanning line 6 is connected to the data scanning circuit 25 (see FIG. 23) which sequentially outputs scanning signals. The signal line 5 is connected to the data transfer circuit 24 (see FIG. 23) which transfers data signals. The data transfer circuit 24 outputs a display data signal to the signal line 5 for every scanning line or every pixel. When the scanning line 6 is made active, the TFT 3 is turned on, allowing a charge corresponding to the display data signal on the signal line 5 to be stored in the LC capacitance 1. The display is maintained by the voltage applied to the liquid crystal according to the charge stored in the LC capacitance 1.

The LC capacitance 1 is comparatively highly resistive, but, actually, it has a leakage resistance. Accordingly, the charge stored in the LC capacitance 1 leaks, and thus the voltage applied to the liquid crystal decreases before the driving element 3 is next turned on, resulting in the lowering of the quality of the display. In order to prevent the decrease of the applied voltage, the auxiliary capacitance 8 is disposed in parallel with the LC capacitance 1. Thus, the voltage applied to the liquid crystal is maintained by the LC capacitance 1 and the auxiliary capacitance 8.

The liquid crystal of the LC capacitance 1 sandwiched by the pixel electrode and the common electrode needs to be driven by an alternate voltage signal. A flicker may be generated by periodically inverting the polarity of the driving voltage to be applied to the liquid crystal. In order to prevent this flickering, 1H reverse driving is often used where the polarity of the driving voltage is reversed every scanning line. However the 1H reverse driving raises a problem as follows. Since a large voltage difference is produced between adjacent scanning lines, it is not possible to change the alignment of the liquid crystal molecules following the change in the voltage. This makes the boundaries of pixels between adjacent scanning lines unclear, thus losing the sharpness of the display. In order to solve this problem, a black matrix may be provided so as to be disposed between the scanning lines. This black matrix, however, lowers the numerical aperture of the LCD apparatus, thus darkening the resultant image displayed.

When a color image is displayed, a field sequential scanning system in which the scanning is conducted separately for each color is effective as one of the methods for solving the above problem. The field sequential scanning system is a coloring technique where two or more colors are displayed by temporal mixing. For example, Japanese Patent Application No. 3-77983 (Japanese Laid-Open Patent Publication No. 4-310925) filed by the same applicant as the present application, proposes two examples of driving methods adopting the field sequential scanning system. FIG. 25 shows one of the examples, where a driving circuit 28 for each pixel includes a buffer amplifying circuit 2 connected between a driving element 3 and an LC capacitance 1 and a holding capacitance 4 (capacitance value $C_H$) connected in parallel between the buffer amplifying circuit 2 and the LC capacitance 1.

FIG. 26 is a timing chart showing an operation of the driving circuit 28. One TV field period is time-divided into three for R, G, and B colors. Data for display for each of the R, G, and B images is transferred to the pixel portion during a significantly short time $\tau$ in the ⅓ TV field period for each color. The display is conducted during the remaining display time TR, TG, or TB for each color. The buffer amplifying circuit 2 which has a high input impedance ensures that the transferred display data is held in the holding capacitance 4. This makes it possible for the LC capacitance 1 to maintain a charge until next display data is transferred (i.e., during the display time TR, TG, and TB).

FIG. 27 shows the sequential scanning of the first scanning line through the last n-th scanning line during the transfer time $\tau$, taking the display data for the R image as an example. As shown in FIG. 27, the ON time for each scanning line is $\tau/n$.

The other example of the above-described conventional technique is shown in FIG. 28, where a driving circuit 29 for each pixel includes another holding capacitance and two switches in addition to the driving circuit 28 described above. A common terminal of one switch SW1 is connected to a drain electrode of a driving element 3, while a common terminal of the other switch SW2 is connected to a gate of a buffer amplifying circuit 2 composed of a transistor. One of contacts of the switch SW1 is connected to one of the contacts of the switch SW2, while the other contact of the switch SW1 is connected to the other contact of the switch SW2. A holding capacitance 4*a* is formed between one connection of the switches SW1 and SW2 and a common signal line 7, while a holding capacitance 4*b* is formed between the other connection of the switches SW1 and SW2 and the common signal line 7. By switching the switches SW1 and SW2, a charge is stored in one of the holding capacitances 4*a* and 4*b*, while an image is displayed with a voltage obtained by a charge held in the other of the holding capacitances 4*a* and 4*b*.

With the above configuration, the transfer of display data to the holding capacitance and the writing of the display data to the LC capacitance 1 can be alternately conducted. FIG. 29 is a timing chart showing an operation of the driving circuit 29. As shown in FIG. 29, display data for colors are transferred (written) to the holding capacitances 4*a* and 4*b* alternately. Thus, display data for one color can be transferred, while the image display of another color is conducted. Accordingly, the transfer time $\tau$ of display data for each color can be extended to as long as the ⅓ TV field period. Also, the display of the R image, G image, and B image within one TV field period is possible.

In the above field sequential scanning system, when data is transferred to the pixel portion in a manner as shown in FIGS. 26 and 27, the data is sequentially written in all the pixels connected to the scanning lines during a time t. The time t is a period of time during which a display data signal is sufficiently written in the last row of pixels (the n-th scanning line) located farthest from the data transfer circuit 24 for applying a voltage required for the display to the LC capacitance 1. In this sequential scanning, the display time for the scanning lines located on the top portion of the screen is different from that for the scanning lines located on the bottom portion of the screen. Due to this difference in display time, troubles such as variation in luminance and flickering occur in the display apparatus 18. Further, since the effective display time as an image gradually decreases as the scanning proceeds to the lower scanning lines, the entire brightness of the screen gradually decreases. In the cases of the driving circuits 28 and 29 described above, the display time for each color is the same. Because the sense of eyesight is different for different colors, an image displayed on the screen with the same display time for the colors results in lacking natural color tone.

In general, in the above conventional display apparatus 18, the pixel display portion 27 only, or together with the data transfer circuit 24 and/or data scanning circuit 25 are formed on the same substrate, while other components are disposed as peripheral circuits. A monolithic structure will be described more concretely as follows.

In the case of an LCD apparatus using amorphous silicon TFTs, the driving element 3 and the auxiliary capacitance 8 are monolithically mounted on one substrate. The drivers and other circuits are formed as ICs on the periphery of the LCD apparatus, or housed in a control system separated from the LCD apparatus.

In the case of an LCD apparatus using poly-silicon TFTs, the data transfer circuit 24 and/or the data scanning circuit 25 may also be monolithically mounted on the substrate, as well as the driving element 3 and the auxiliary capacitance 8. This integration of the peripheral driving circuits is possible because polysilicon has a larger mobility compared with amorphous silicon. However, the D/A converters 23, the A/D converters 20, the memory 21, control circuits 26, and the like are formed as separate ICs on the periphery of the LCD apparatus or housed in a control device separated from the LCD apparatus.

The conventional display apparatus 18 with the above structure where individual ICs are connected to the LCD substrate has the following problems.

1) Unstable Circuit Operations Caused by Wirings Between IC and the LCD Substrate When circuits having different potentials from one another are connected in a loop through an earth line, a signal line, a source line, and the like, oscillation may be generated in some cases. The time constant for the oscillation is determined by the capacitance value and the resistance value of the wiring, the circuit, and the like. When the time constant is in a predetermined range, oscillation occurs in the circuit. When oscillation occurs in the circuit, the IC malfunctions, failing to play its allocated function. The circuits shown in FIG. 23 include a number of loop wirings. Actually, there has arisen problems of lowering in stability caused by oscillation. Especially, wirings $P_1$ connecting the data input terminals 10R, 10G, and 10B and the respective A/D converters 20 tend to be easily oscillated.

2) Generation of Noise

A long wiring acts as an antenna receiving electromagnetic waves propagating in a space and wave signal generated from another wiring. Such received wave signals may be added to a display signal on the wiring, resulting in generating a noise. The generation of noise is serious because it may cause troubles such as variation in the level of the signal to be supplied from the IC and malfunction of the IC. Referring to FIG. 23, especially liable to generate noise are the wirings $P_1$ between the data input terminals 10R, 10G, and 10B and the respective A/D converters 20, wirings $P_3$ between the D/A converters 23 and the data transfer circuit 24, and wirings $P_4$ between the memory 21 and the memory selection circuit 22.

3) Signal Delay

Long wiring may cause a delay in the transmission of a signal due to the capacitance of the wiring itself and the contact capacitance at the contact between the wiring and the IC. Such a signal delay is more serious as the wiring is longer and more complicated. Because the contact capacitance between the wiring and the IC varies as the IC varies, the degree of the signal delay is different among wirings. This makes it difficult to equalize the degree of the signal delay or to compensate the signal delay. Especially, a signal delay in wiring connected to an IC which requires high-speed operation may cause a serious problem. Referring to FIG. 23, the signal delay generated in wirings $P_2$ between the A/D converters 20 and the respective memory elements of the memory 21 may especially cause a problem.

4) Variation in IC Performance

The display apparatus 18 shown in FIG. 23 uses a number of ICs. The performance of these ICs varies among ICs, mainly because different production lots and wafers have different performances from each other. This variation in IC performance causes trouble as follows. When the levels of the conversion obtained by the D/A converters 23 are different from one another due to the variation in IC performance, the levels of converted data signals for display vary from one another. This results in the difference in luminance among the columns of pixels corresponding to the respective D/A converters 23, producing an image having vertical streaks with different luminance. Similar troubles arise in the ICs of the A/D converters 20, the data transfer circuit 24, the data scanning circuit 25, and the like. In order to solve these troubles, efforts have been made to equalize the performance of the ICs. In some cases, the ICs to be used have been specially selected. This variation in performance of the ICs is especially serious in the D/A converters 23 and the data transfer circuit 24.

5) High Cost and Many Manufacturing Steps

The conventional display apparatus having a number of ICs is expensive because costs for individual ICs, a print board on which the ICs are mounted, wiring, and the assembly of these components are required. Also, the conventional display apparatus requires a number of manufacturing steps because the steps of mounting, interconnecting, and assembling are required.

6) Large-scaled System

The pixel display portion substantially constructed of a pair of substrates can actually be made thinner and lighter. However, this advantage of the pixel display portion cannot be utilized because, with the peripheral circuits (print boards and ICs) added to the pixel display portion, the appearance of the entire LCD becomes large.

As described hereinbefore, the conventional display apparatus 18 realizes a color display by time-dividing the period of an image data signal input thereto into three. Accordingly, the frequency of the display signal output from the memory 21 is three times that of the input image data signal. Further, with the recent development of high-definition television sets (HDTV), it is more often required for the image display apparatus to respond to a signal of a higher frequency which is supplied from a high-frequency signal source. An LCD substrate made of polysilicon or single crystal silicon is limited in the response frequency. Accordingly, when the frequency of a signal processed by a circuit on the substrate exceeds the response frequency of the substrate, trouble arises. The signal is delayed because the response of the substrate fails in following the signal (the transmitting velocity of the signal is slow). The produced heat of the substrate increases, causing unfavorable influence to the operation of the IC and the optical properties of the liquid crystal.

In the case of the driving circuit 29 of which operation was described referring to FIG. 28, the transfer time of the image data signal was extended to as long as the ⅓ TV field period. However, the reduction of the signal processing speed (sampling speed) is insufficient.

The polarity of the display signal is inverted in order to prevent the degradation of the liquid crystal, as described above. Thus, in order to increase the response speed of the liquid crystal, it is necessary to increase the voltage to be applied to the liquid crystal. For this reason, the LCD substrate needs to have a sufficiently large withstand voltage. Increasing the withstand voltage of the substrate raises the following problems: (1) The response frequency of the substrate is lowered. Accordingly, the above-described troubles relating to the lowering of the response frequency occur more significantly. (2) The design rule of the system becomes large, so the thickness of the wirings and the size of various elements (transistors, capacitors, etc.) increase, making it difficult to make the entire display apparatus compact.

SUMMARY OF THE INVENTION

The image display apparatus of this invention, which includes display means having a plurality of pixels arranged in a matrix and driven by a field sequential scanning system, the image display apparatus, includes: display driving means for supplying a display signal to each of the pixels; scanning means for supplying a scanning signal to each of the pixels, the scanning means allowing the pixel to receive a charge corresponding to the display signal during a predetermined write time; and write time modulation means for modulating the write time of the pixel according to the progress of the scanning by the scanning means.

In one embodiment, the scanning means has a plurality of scanning lines extended in a first direction of the matrix, each of the scanning lines being connected to a plurality of pixels arranged along the first direction and supplying the scanning signal to the connected pixels, the display driving means has a plurality of signal lines extended in a second direction of the matrix, each of the signal lines being connected to a plurality of pixels arranged along the second direction and supplying the display signal to the connected pixels, and the write time modulation means modulates the write time so that the write time for the pixels connected to at least one scanning line among the plurality of scanning lines is different from the write time for the pixels connected to the other scanning lines.

In another embodiment, the display driving means supplies the display signal to the pixels for a predetermined transfer time, and the write time modulation means changes the transfer time according to an image to be displayed.

In another embodiment, the image display apparatus further includes signal identification means for identifying the display signal based on a predetermined characteristic of the display signal to generate signal identification information, wherein the write time modulation means modulates the transfer time based on the signal identification information.

In another embodiment, the display signal is a video signal, and the signal identification means identifies the video signal based on at least one of the differences in the color component and the luminance component of the video signal.

In another embodiment, the image display apparatus further includes memory means for storing the display signal to output the stored display signal to the display driving means at a predetermined timing, wherein the write time modulation means controls the timing when the display signal is output from the memory means, thereby to modulate the transfer time.

In another embodiment, the display means is a liquid crystal display device.

Alternatively, the image display apparatus of the present invention, including display means having a plurality of pixels arranged in a matrix and driven by a field sequential scanning system, includes: analog/digital conversion means for converting an input analog video signal to a digital data signal; memory means for receiving the digital data signal and storing the digital data signal separately by every field and for one or more fields at the same time; time-axis modulation means for receiving the digital data signal stored in the memory means and temporally expanding or compressing the received digital data signal; digital signal conversion means for converting the digital data signal temporally expanded or compressed to a display data signal; data transfer means for receiving the display data signal and transferring the display data signal to the display means; data scanning means for specifying a pixel in which the transferred display data signal is to be stored among the plurality of pixels of the display means; and control means for controlling the analog/digital conversion means, the memory means, the time-axis modulation means, the digital signal conversion means, the data transfer means, and the data scanning means, so as to effect the display, wherein each of the pixels includes data holding means for holding the display data signal to be stored in the pixel, and at least one of the analog/digital conversion means, the memory means, the time-axis modulation means, the digital signal conversion means, and the control means, the data transfer means, the data scanning means, and the data holding means are formed on the same substrate.

Alternatively, the image display apparatus of the present invention, including display means having a plurality of pixels arranged in a matrix and driven by a field sequential scanning system, includes: sampling means for sampling an input analog video signal to generate a display data signal; memory means for receiving the display data signal and storing the display data signal separately by every field and for one or more fields at the same time; data transfer means for receiving the display data signal stored in the memory means and transferring the display data signal to the display means; data scanning means for specifying a pixel in which the transferred display data signal is to be stored among the plurality of pixels of the display means; control means for controlling the sampling means, the memory means, the data transfer means, and the data scanning means, so as to effect the display, wherein each of the pixels includes data holding means for holding the display data signal to be stored in the pixel, and at least one of the sampling means, the memory means, and the control means, the data transfer means, the data scanning means, and the data holding means are formed on the same substrate.

Alternatively, the image display apparatus of the present invention, including display means having a plurality of pixels arranged in a matrix and driven by a field sequential scanning system, the image display apparatus includes: sampling means for sampling an input analog video signal to generate a display data signal; memory means for receiving the display data signal and storing the display data signal; data transfer means for receiving the display data signal stored in the memory means and transferring the display data signal to the display means; data scanning means for specifying a pixel in which the transferred display data signal is to be stored among the plurality of pixels of the display means; data holding means disposed for each of the pixels for holding the display data signal to be stored in the pixel, wherein the sampling means and the memory means are disposed for each of the pixels of the display means.

According to one embodiment, the sampling means, the memory means, the data scanning means, and the data holding means are formed on the same substrate.

According to another embodiment, the image display apparatus is a liquid crystal display apparatus.

According to another embodiment, each of the means formed on the same substrate is formed on a substrate made of a material selected from the group consisting of single crystal silicon, single crystal silicon formed on sapphire, diamond, and polysilicon.

According to another aspect of the present invention, a method for driving an image display apparatus by a field sequential scanning system is provided. The image display apparatus includes display means having a plurality of pixels arranged in a matrix, scanning means having a plurality of scanning lines extended in a first direction of the matrix, each of the scanning lines being connected to a plurality of pixels arranged along the first direction, and display driving means having a plurality of signal lines extended in a second direction of the matrix, each of the signal lines being connected to a plurality of pixels arranged along the second direction. The method includes the steps of: (a) supplying a display signal to the pixels through the signal lines for a predetermined transfer time; (b) selecting one scanning line among the plurality of scanning lines; (c) supplying a scanning signal to the pixels connected to the selected scanning line through the selected scanning line; (d) allowing the pixels connected to the selected scanning line to receive a charge corresponding to the display signal according to the scanning signal during a predetermined write time; and (e) modulating the write time according to the selected scanning line so that the write time for the pixels connected to at least one scanning line among the plurality of scanning lines is different from the write time for the pixels connected to the other scanning lines.

In one embodiment, in the step (e), the write time is modulated so as to be gradually changed in the order of the selection of the scanning lines.

In another embodiment, the method further includes the step of (f) changing the transfer time according to the image to be displayed.

In another embodiment, the step (f) includes the steps of: (g) identifying the display signal based on a predetermined characteristic of the display signal to generate signal identification information; and (h) modulating the transfer time based on the signal identification information.

In another embodiment, the display signal is a video signal, and, in the step (g), the video signal is identified based on at least one of the differences in the color component and the difference of the luminance component of the video signal.

In another embodiment, the step (f) includes the steps of: (i) storing the display signal; (j) outputting the stored display signal to the display driving means at a predetermined timing; and (k) modulating the transfer time by controlling the timing.

Alternatively, the method for driving an image display apparatus having a plurality of pixels arranged in a matrix, by a field sequential scanning system, according to the present invention includes the steps of: converting an input analog video signal to a digital data signal; storing the digital data signal separately by every field and for one or more fields at the same time; temporally expanding or compressing the stored digital data signal to effect the time-axis modulation; converting the digital data signal temporally expanded or compressed into a display data signal; (a) transferring the display data signal to the display means during a predetermined transfer time; (b) specifying a pixel in which the transferred display data signal is to be stored among the plurality of pixels of the display means; (c) allowing the pixel to receive a charge corresponding to the display signal during a predetermined write time; (d) repeating the steps (a), (b), and (c) for a predetermined number of operations; and (e) modulating the write time of each pixel according to the number of operations of the step (b) obtained in the step (d).

In one embodiment, in the step (e), the write time of the step (c) at one operation among the predetermined number of operations repeated in the step (d) is modulated so as to be different from the write time of the step (c) at the other operations.

In another embodiment, the method further includes the step of (f) changing the transfer time according to the image to be displayed.

In another embodiment, the step (f) includes the steps of: (g) identifying the display signal based on a predetermined characteristic of the display signal to generate signal identification information; and (h) modulating the transfer time based on the signal identification information.

In another embodiment, the display signal is a video signal, and, in the step (g), the video signal is identified based on at least one of the differences in the color component and the luminance component of the video signal.

In another embodiment, the step (f) includes the steps of: (i) storing the display signal; (j) outputting the stored display signal to the display driving means at a predetermined timing; and (k) modulating the transfer time by controlling the timing.

Alternatively, the method for driving an image display apparatus having a plurality of pixels arranged in a matrix, by a field sequential scanning system, according to the present invention includes the steps of: sampling an input analog video signal to generate a display data signal; storing the display data signal separately by every field and for one or more fields at the same time; (a) transferring the display data signal stored in the memory means to the display means; (b) specifying a pixel in which the transferred display data signal is to be stored among the plurality of pixels of the display means to effect data scanning; (c) allowing the pixel to receive a charge corresponding to the display signal during a predetermined write time; (d) repeating the steps (a), (b), and (c) for a predetermined number of operations; and (e) modulating the write time of each pixel according to the number of operations of the step (b) obtained in the step (d).

In one embodiment, in the step (e), the write time of the step (c) of one operation among the predetermined number of operations repeated in the step (d) is modulated so as to be different from the write time of the step (c) at the other operations.

In another embodiment, the method further includes the step of (f) changing the transfer time according to the image to be displayed.

In another embodiment, the step (f) includes the steps of: (g) identifying the display signal based on a predetermined characteristic of the display signal to generate signal identification information; and (h) modulating the transfer time based on the signal identification information.

In another embodiment, the display signal is a video signal, and, in the step (g), the video signal is identified based on at least one of the differences in the color component and the luminance component of the video signal.

In another embodiment, the step (f) includes the steps of: (i) storing the display signal; (j) outputting the stored display signal to the display driving means at a predetermined timing; and (k) modulating the transfer time by controlling the timing.

Thus, the invention described herein makes possible the advantages of (1) providing an image display apparatus with a significantly enhanced display quality, which can prevent problems such as variation in luminance, flickering, and diminishing brightness, and can display an image with a natural tone, and (2) providing an image display apparatus which is small, simple in the circuit configuration, and stable in the circuit operation by monolithically mounting peripheral circuits on the same substrate, and can display clearer images by reducing the sampling speed.

These and other advantages of the present invention will become apparent to those skilled in the art upon reading and understanding the following detailed description with reference to the accompanying figures.

DESCRIPTION OF THE PREFERRED EMBODIMENTS

The present invention will be described by way of example with reference to the accompanying drawings as follows.

EXAMPLE 1

Figure 1:
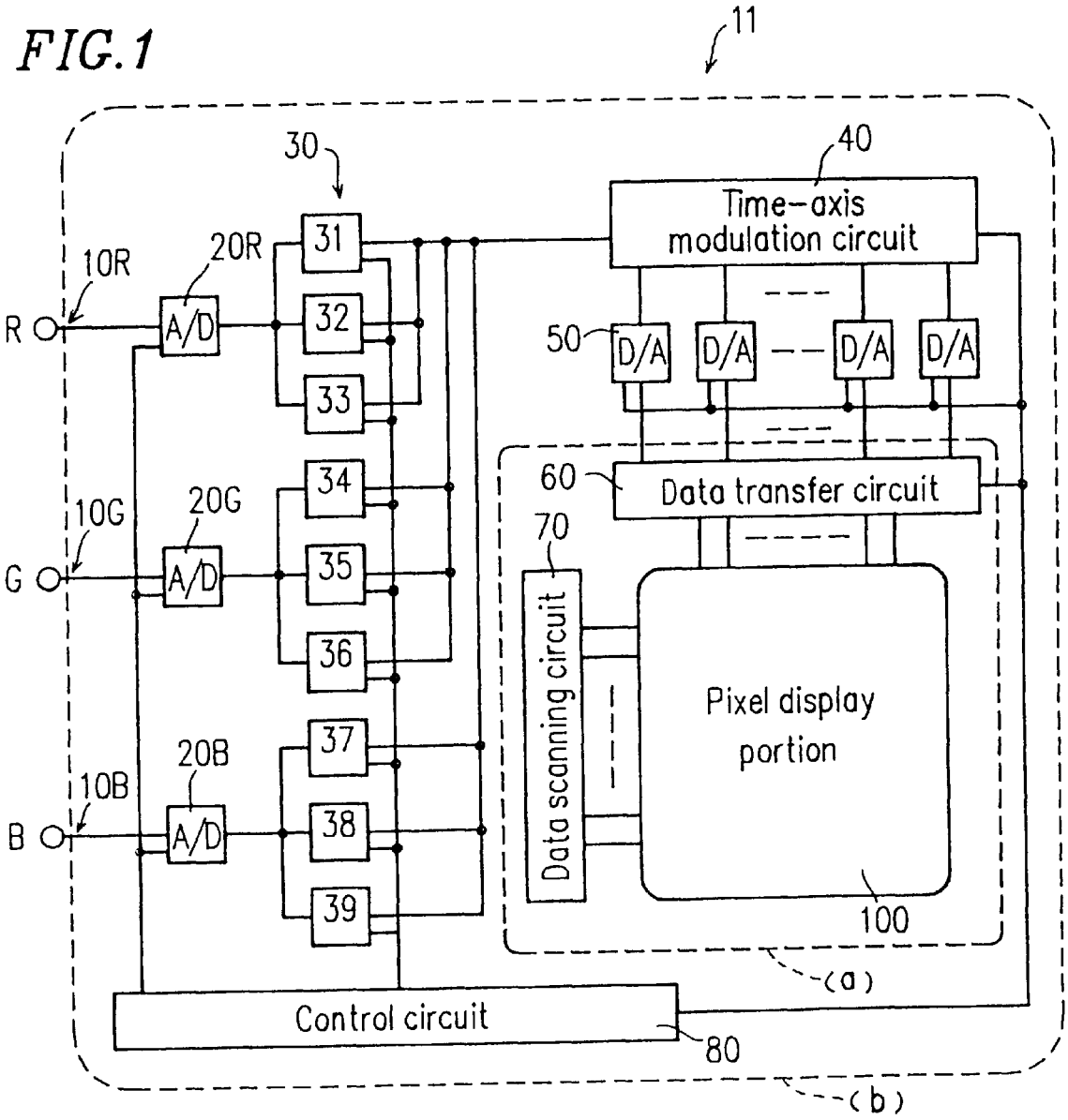
FIG. 1 is a schematic view of a configuration of an image display apparatus of a first example according to the present invention.

FIG. 1 schematically shows an image display apparatus 11 of a first example according to the present invention. FIG. 1 specifically shows a configuration of a signal processing system surrounding a pixel display portion of the image display apparatus 11. The image display apparatus 11 includes a pixel display portion 100 having a plurality of pixels arranged in a matrix, and is driven by the field sequential scanning system. The image display apparatus 11 further includes an A/D converter 20 composed of A/D conversion elements 20R, 20G, and 20B for converting input analog video signals into digital data signals, a memory 30 for storing converted digital data signals so that the data can be separately stored by every field and the data corresponding to one or more fields can be stored at the same time, a time-axis modulation circuit 40 for temporally expanding or compressing the digital data signals received from the memory 30, a D/A converter 50 composed of a plurality of D/A conversion elements for converting the temporally expanded or compressed digital data signals into analog data signals for display, a data transfer circuit 60 for transferring the data signals for display to the pixel display portion 100, a data scanning circuit 70 for specifying pixels in which the transferred data signals for display are to be stored among the plurality of pixels of the pixel display portion 100, and a control circuit 80 for controlling the above circuits.

A plurality of scanning lines are connected to the data scanning circuit 70. The scanning lines extend in a first direction ("row" direction) of the pixel matrix, and a row of pixels are connected to each of the scanning lines. In response to a control signal output from the control circuit 80, the data scanning circuit 70 selects a scanning line having pixels in which the display data signal should be stored, and supplies a scanning signal to the selected scanning line.

A plurality of signal lines are connected to the data transfer circuit 60. The signal lines extend in a second direction ("column" direction) of the pixel matrix, and a column of pixels are connected to each of the signal lines. The data transfer circuit 60 supplies a display signal to pixels connected through the signal line.

In this example, a video signal is input to the display apparatus 11 after being divided into a red signal (R), a green signal (G), and a blue signal (B). These color signals for display (hereinafter, simply referred to as "color signals") are supplied to data input terminals 10R, 10G, and 10B, respectively. The A/D conversion elements 20R, 20G, and 20B correspond to the color signals R, G, and B, respectively. The color signals converted into digital signals by the A/D conversion elements 20R, 20G, and 20B are then output to the memory 30.

The memory 30 is composed of nine data memory elements 31 to 39, each storing one field of input signals. In this example, three data memory elements are allocated for each color signal. Specifically, the data memory elements 31, 32, and 33 are connected to the A/D conversion element 20R, the data memory elements 34, 35, and 36 are connected to the A/D conversion element 20G, and the data memory elements 37, 38, and 39 are connected to the A/D conversion element 20B. The memory 30 stores three field periods of data for each color signal, an n-th field, an (n+1)th field, and an (n+2)th field.

The color signals stored in the memory 30 are output to the time-axis modulation circuit 40 under the control of the control circuit 80. The time-axis modulation circuit 40 expands or compresses the color signal supplied from the memory 30 along the time axis. At this time, as will be described later, when each of the data memory elements 31 to 39 of the memory 30 has a plurality of outputs in parallel, each color signal can be further divided into a plurality of signals along the time axis and output in parallel (see FIG. 6). By this operation, each color signal can be further temporally expanded or compressed. The modulated color signal (digital signal) is input to the D/A converter 50 so as to be converted into an analog signal. The D/A converter 50 is composed of a plurality of D/A conversion elements arranged along the row direction of the pixel matrix of the pixel display portion 100. The D/A conversion elements correspond to the number of outputs in parallel for each of the data memory elements 31 to 39 of the memory 30. The analog color display signal output from the D/A converter 50 are then supplied to the data transfer circuit 60, which generates a voltage signal for driving the liquid crystal based on the analog color display signal, and supplies the voltage signal to the pixel display portion 100 based on a control signal from the control circuit 80.

An image is displayed on the pixel display portion 100 in the following manner. The scanning lines are sequentially selected (scanned) by the data scanning circuit 70, so that the voltage signal (display signal) is supplied to a pixel connected to the selected scanning line from the data transfer circuit 60.

Figure 25:
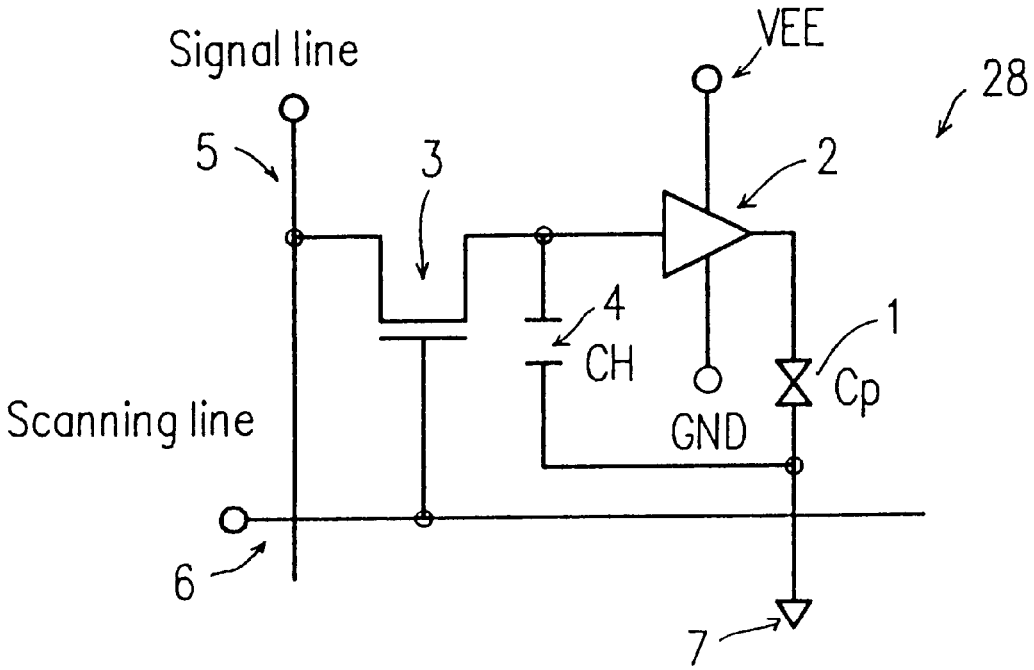
FIG. 25 PRIOR ART
FIG. 25 shows another driving circuit for a pixel portion of a conventional liquid crystal display apparatus.
Figure 26:
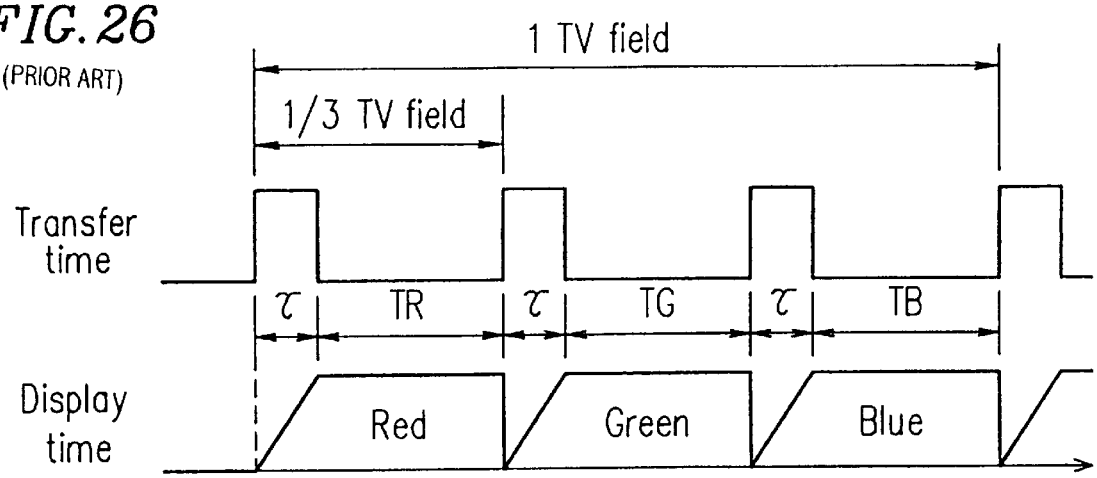
FIG. 26 (PRIOR ART)
FIG. 26 is a timing chart showing the operation of the driving circuit of FIG. 25.
Figure 27:
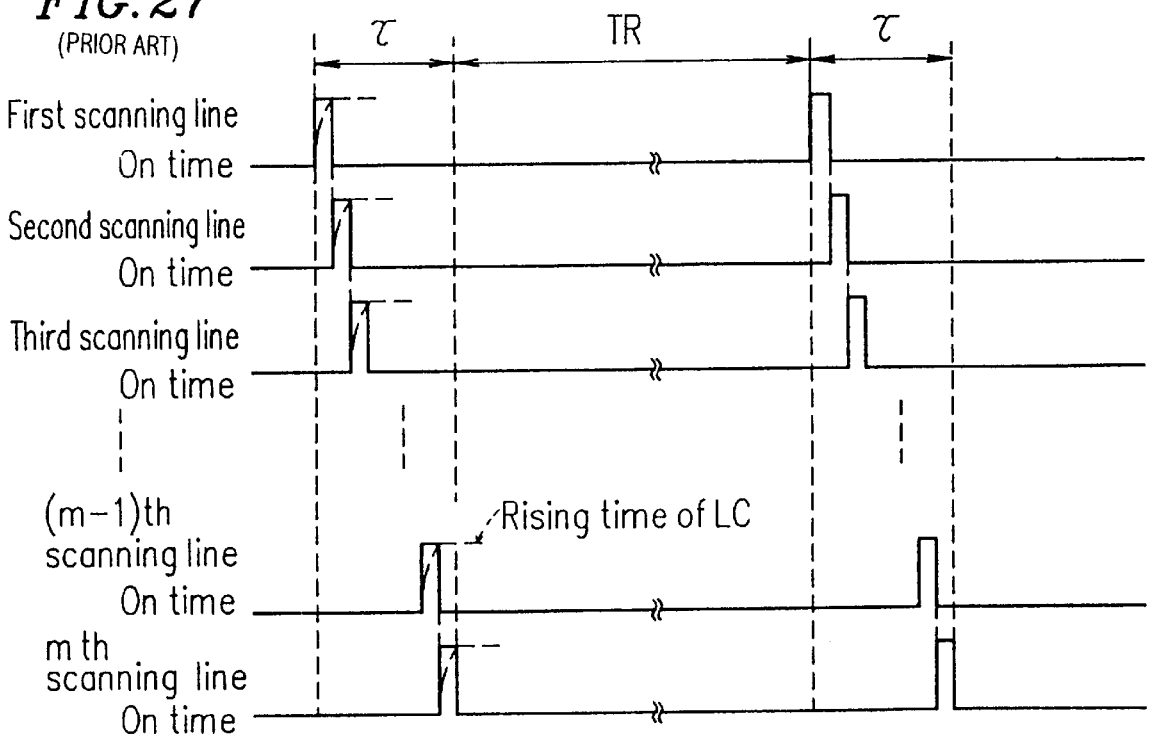
FIG. 27 (PRIOR ART)
FIG. 27 is a timing chart showing the write time of display data for a conventional liquid crystal display apparatus.
Figure 28:
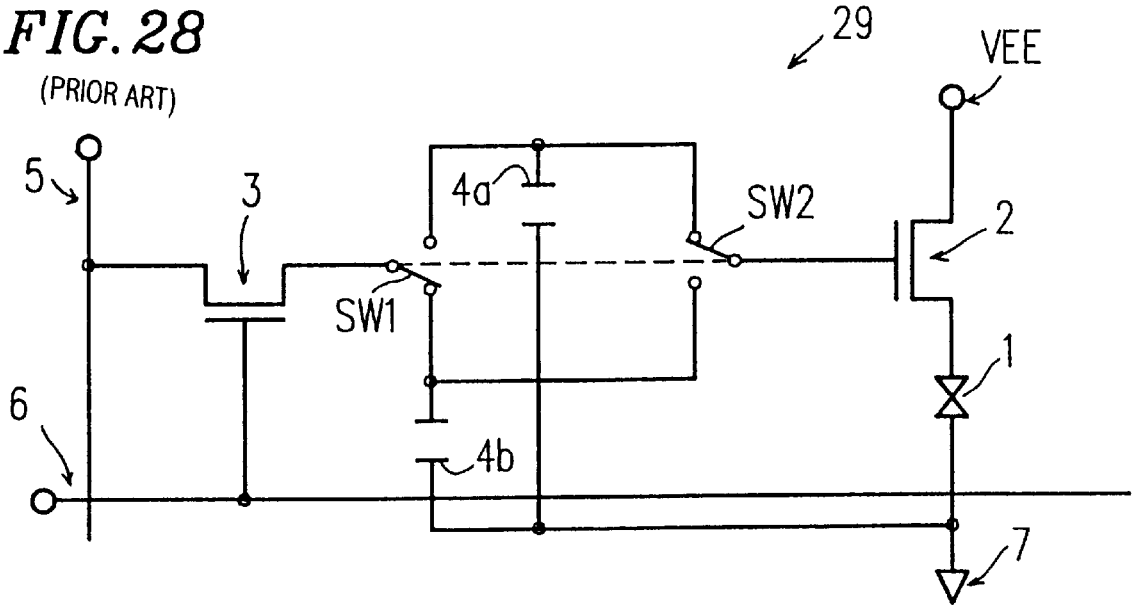
FIG. 28 (PRIOR ART)
FIG. 28 shows yet another driving circuit of a pixel portion of a conventional liquid crystal display apparatus.
Figure 29:
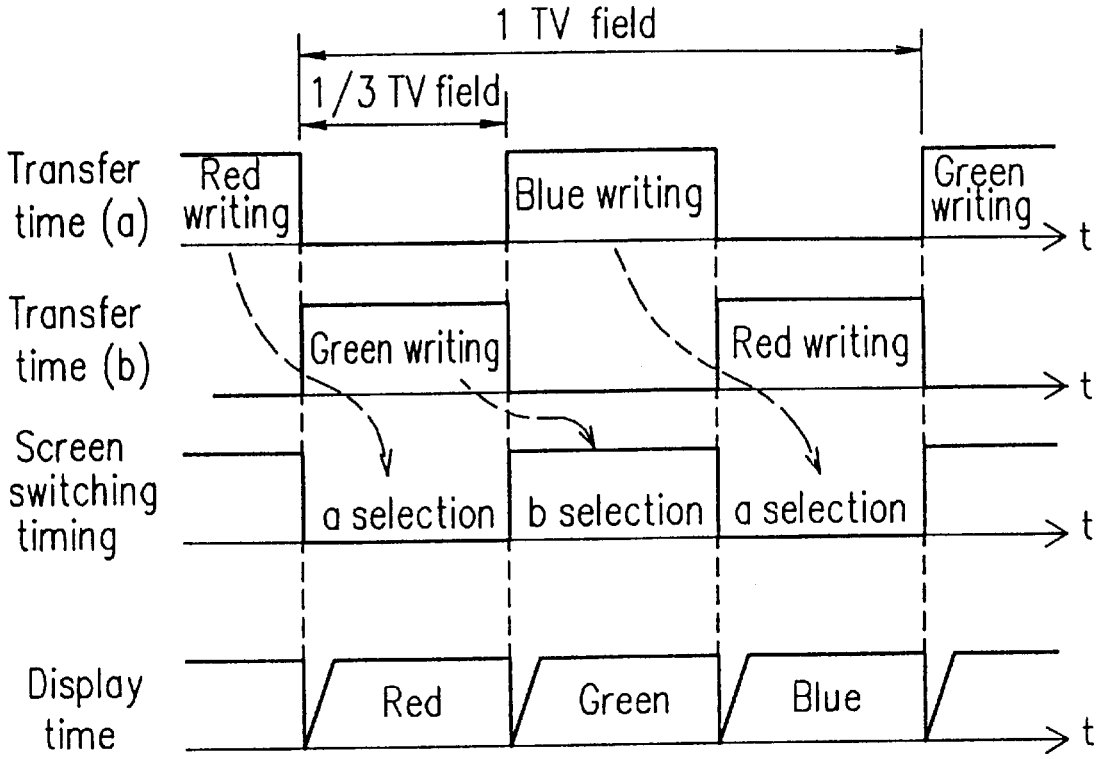
FIG. 29 PRIOR ART
FIG. 29 is a timing chart showing the operation of a driving circuit shown in FIG. 28.

The configuration of each pixel is similar to the equivalent circuits shown in FIGS. 25 and 28. In other words, the driving circuit of each pixel is similar to the driving circuits 28 and 29 shown in FIGS. 25 and 28, which includes a driving element, an auxiliary capacitance, a buffer amplifying circuit, and, optionally, a holding capacitance and a switch. By these components, data are held in the pixel display portion 100.

In this example, not only the data transfer circuit 60 and the data scanning circuit 70, but also other peripheral driving circuits (including the A/D converter 20, the memory 30, the time-axis conversion circuit 40, the D/A converter 50, and the control circuits 80) are mounted on the substrate on which the pixel display portion 100 is formed. In other words, the components encircled by a dotted line (b) shown in FIG. 1 are formed on the same substrate together with the components encircled by a dotted line (a). It is not necessary to form all the peripheral components encircled by the dotted line (b) on the same substrate, but at least one of such peripheral components may be formed on the substrate according to a desired circuit design.

In order to form the above peripheral components on the same substrate, the operation speed of the circuits (i.e., the frequency of a sampling signal for digital signal processing) should be lower than the response frequency of the substrate. For example, when a substrate made of single crystal silicon is used, the mobility is 500–1500 $cm^2/Vs$. In this case, the sampling frequency is set so as to be 30 MHz or less.

The sampling frequency can be decreased in the following manner.

According to the image display apparatus 11, when an interlaced video signal is input, the display is conducted without interlacing. That is, all the information for one TV frame is displayed on the pixel display portion during one TV field period. In this description, a red color signal in the n-th TV field is denoted by $R_n$, a green color signal in the n-th TV field is denoted by $G_n$, and a blue color signal in the n-th TV field is denoted by $B_n$. Likewise, a red color signal, a green color signal, and a blue color signal in the (n+1)th TV field are denoted by $R_{n+1}$, $G_{n+1}$, and $B_{n+1}$, respectively.

Color signals corresponding to three TV fields, i.e., red color signals $R_n$, $R_{n+1}$, and $R_{n+2}$, green color signals $G_n$, $G_{n+1}$, and $G_{n+2}$, and blue color signals $B_n$, $B_{n+1}$, and $B_{n+2}$, are input to the image display apparatus 11. These analog signals are converted into digital signals by the A/D converter 20, and then input to the memory 30.

The above digital signals are input to the memory 30 in the following manner. The color signals $R_n$, $G_n$, and $B_n$ in the n-th TV field are stored in the data memory elements 31, 34, and 37. The next color signals $R_{n+1}$, $G_{n+1}$, and $B_{n+1}$ in the (n+1)th TV field are stored in the data memory elements 32, 35, and 38. Then, the color signals $R_{n+2}$, $G_{n+2}$, and $B_{n+2}$ in the (n+2)th TV field are stored in the data memory elements 33, 36, and 39. While the color signals in the (n+2)th field are being written in the data memory elements, the color signals in two fields composed of the n-th and (n+1)th fields are output and displayed. This means that all the information covering one TV frame is output and displayed.

Figure 6:
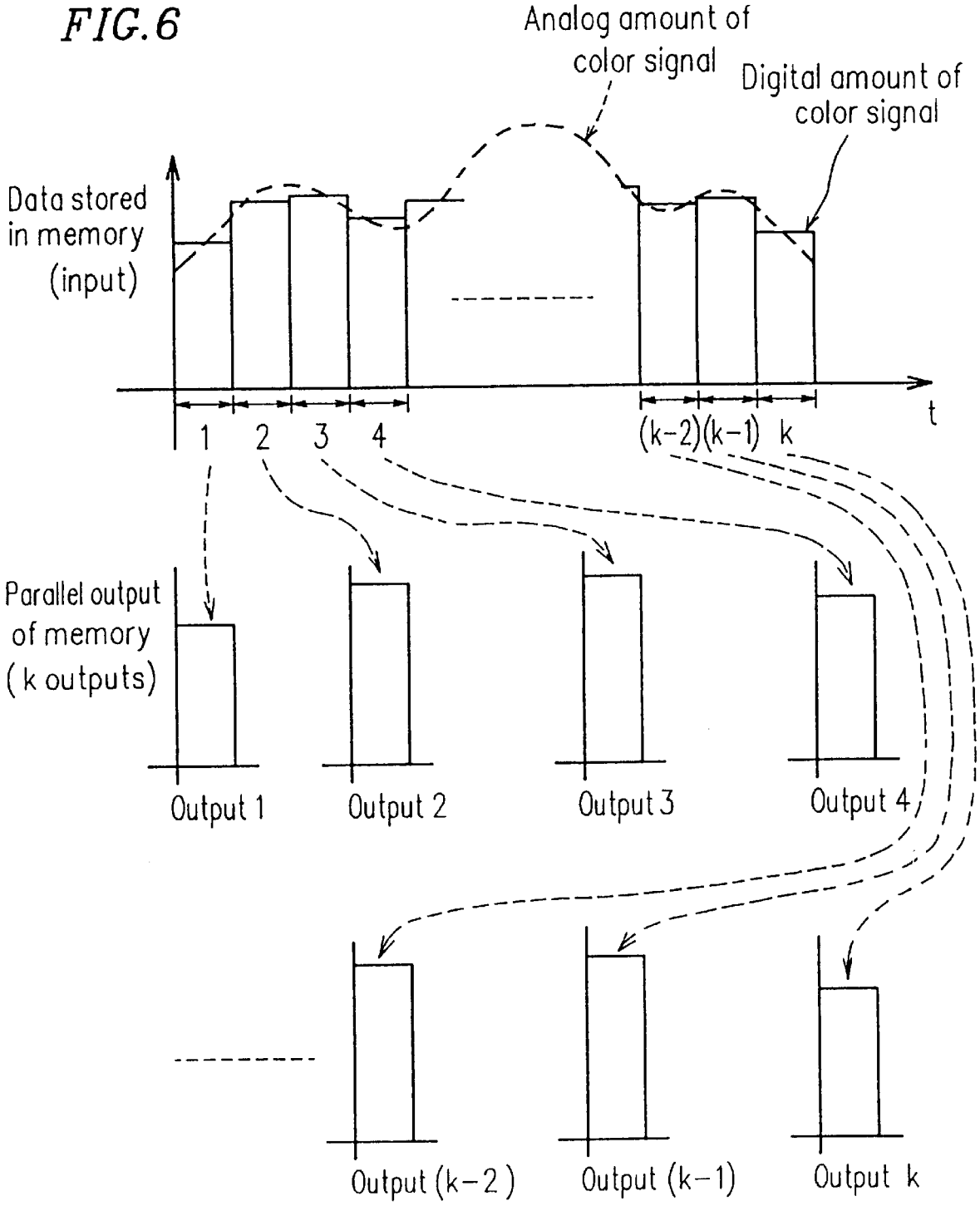
FIG. 6 shows an example of color signals output from a data memory element according to the present invention.

Data of the color signals $R_n$ and $R_{n+1}$ are selected and output from the memory 30 under the control of the control circuit 80. As described earlier, data stored in the memory 30 have been divided along a horizontal time axis (each having a ⅓ TV field period). The data selected and output are expanded along the horizontal time axis by the time-axis modulation circuit 40. When each data memory element of the memory 30 has a plurality of outputs in parallel, each signal can be divided into a plurality of signals and output as shown in FIG. 6. Accordingly, the signal can be further expanded along the time axis, and thus the frequency of the color signal can be reduced.

The temporally expanded data are then converted into analog signals for display by the D/A converter 50. The converted analog signals are input to the data transfer circuit 60, and then supplied to the pixels as voltage signals for driving the liquid crystal.

A method for reducing the frequency will be described.

Figure 2A:
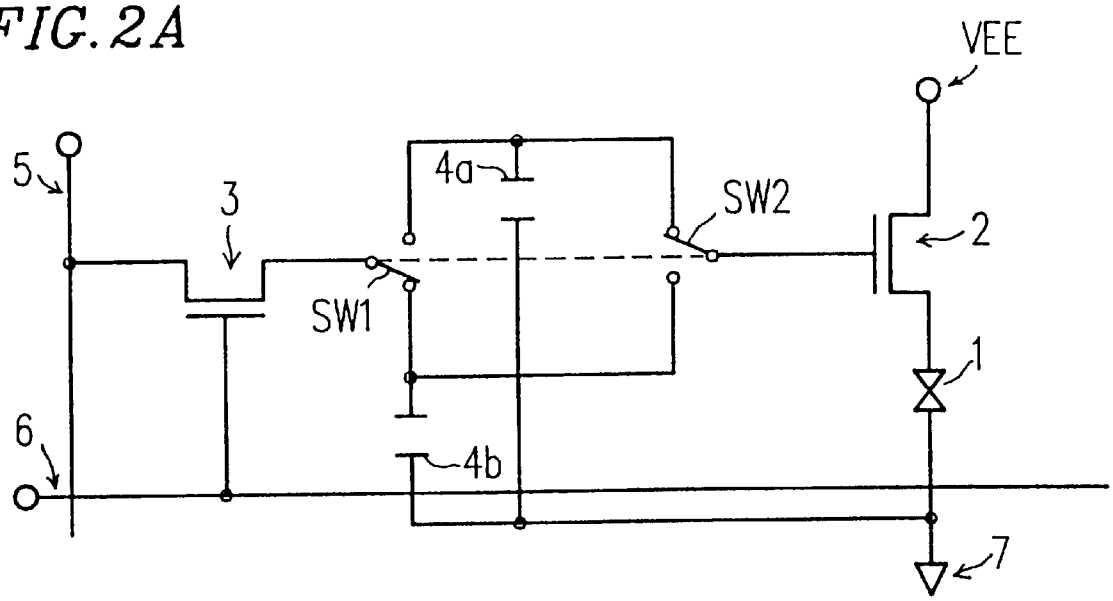
FIG. 2A is a circuit diagram of a driving circuit for a pixel of the image display apparatus of the first example.
Figure 3:
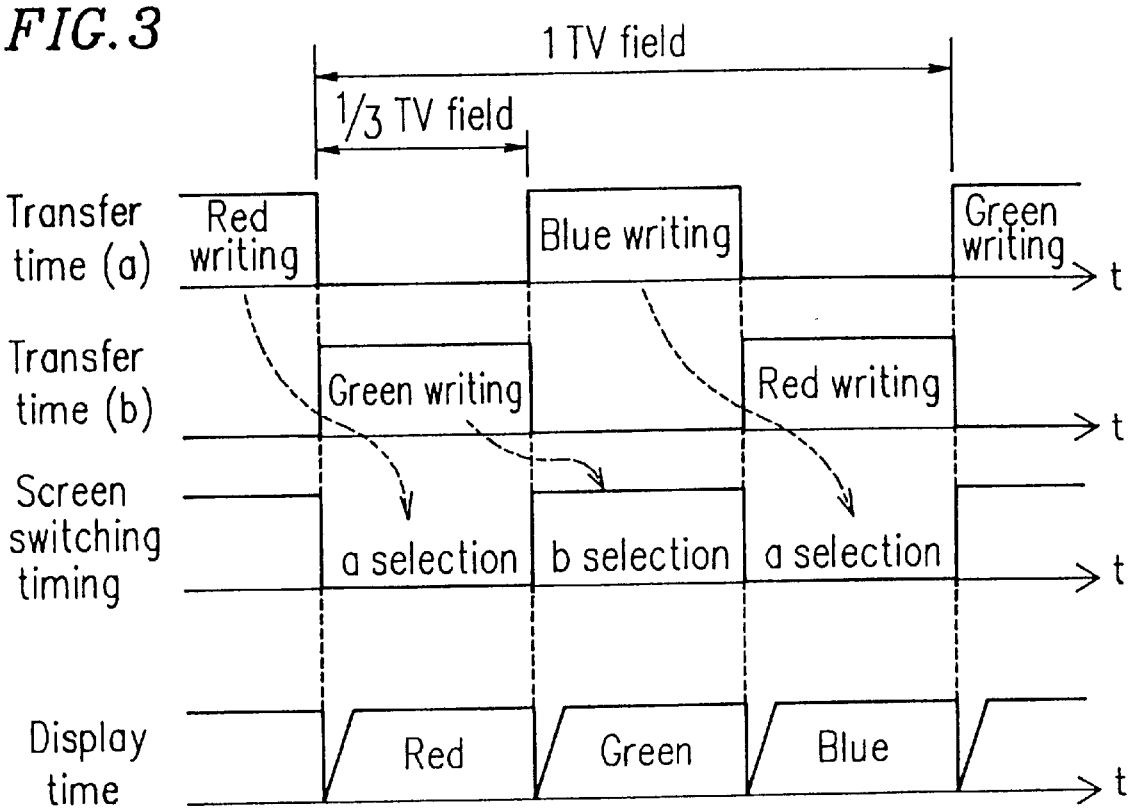
FIG. 3 is a timing chart showing the operation of the driving circuit of FIG. 2A.

The driving circuit for each pixel according to the present invention is shown in FIG. 2A. This driving circuit is similar to the driving circuit 29 of the conventional example described earlier. FIG. 3 is a timing chart showing transfer time $\tau$ and display times TR, TG, and TB for the color signals R, G, and B in the n-th and (n+1)th fields transferred by the data transfer circuit 60. Since the field sequential scanning is conducted for the three color signals to form one TV frame, each color signal is displayed for the ⅓ TV field period. The display data for these three colors are transferred to the holding capacitances 4*a* and 4*b* alternately. Thus, the display data for one color can be transferred while the display of another color is conducted. Accordingly, the transfer time $\tau$ of the display data for each color can be extended to as long as the ⅓ TV field period. By this operation, the frequency of the signal processing can be widely reduced. This makes it possible to mount the peripheral circuits on the LCD substrate monolithically. Further, by providing means for sampling data, which will be described later, and an element for holding data, the transfer time can be as long as one TV field period.

In this example, the time-axis modulation circuit 40 is disposed between the memory 30 and the D/A converter 50 as shown in FIG. 1. According to the present invention, however, the expansion along the time axis may also be realized by changing the timing at which data is read from the memory 30.

Figure 4A:
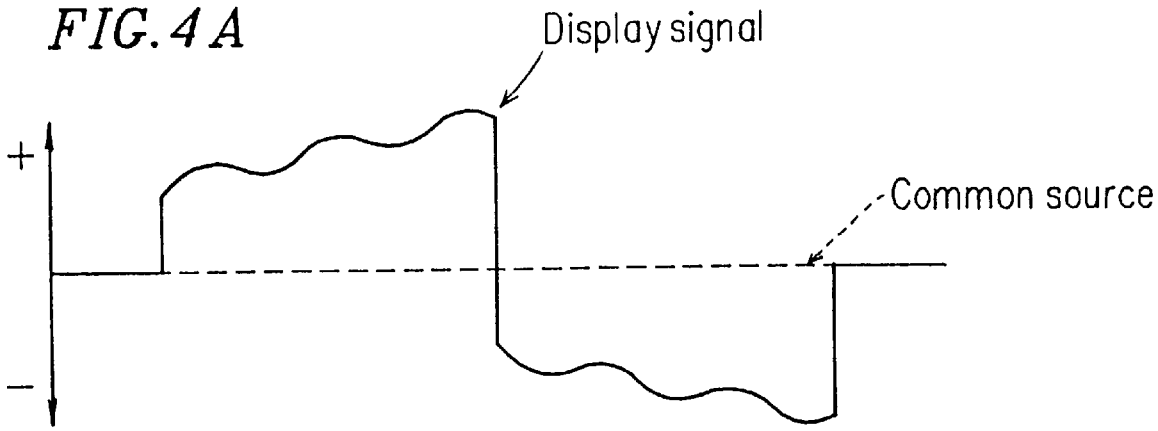
FIG. 4A shows waveforms of a display voltage signal and a common source signal used for a conventional display apparatus.
Figure 4B:
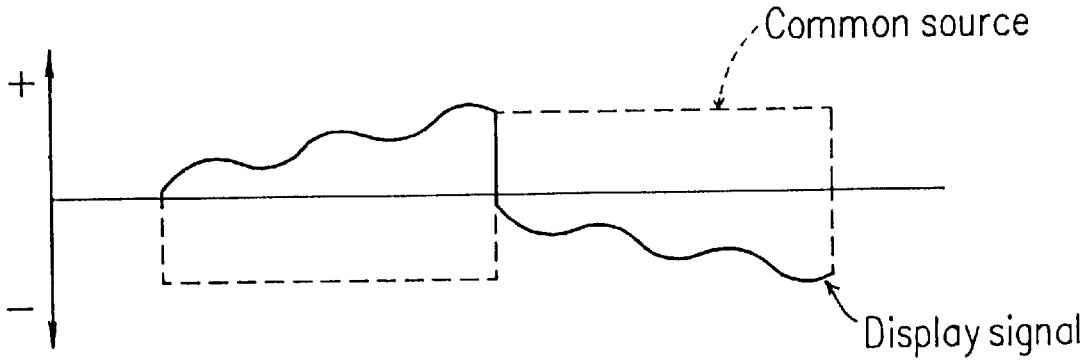
FIG. 4B shows waveforms of a display voltage signal and a common source signal used for an image display apparatus according to the present invention.

In order to form the peripheral circuits on the LCD substrate, it is also naturally required that the response frequency of the substrate should be sufficiently high. In order to obtain a substrate having a high response frequency, the withstand voltage of the substrate should be minimized. Thus, according to the present invention, the following improvement has been made so as to reduce the voltage of the analog signals at the pixel display portion 100. That is, the liquid crystal is driven by an alternating voltage signal so as to prevent the degradation of the liquid crystal (see FIG. 4A). In this operation, as shown in FIG. 4B, a common electric source is alternately driven so as to prevent the amplitude of the voltage signals applied to the liquid crystal from increasing.

Figure 2B:
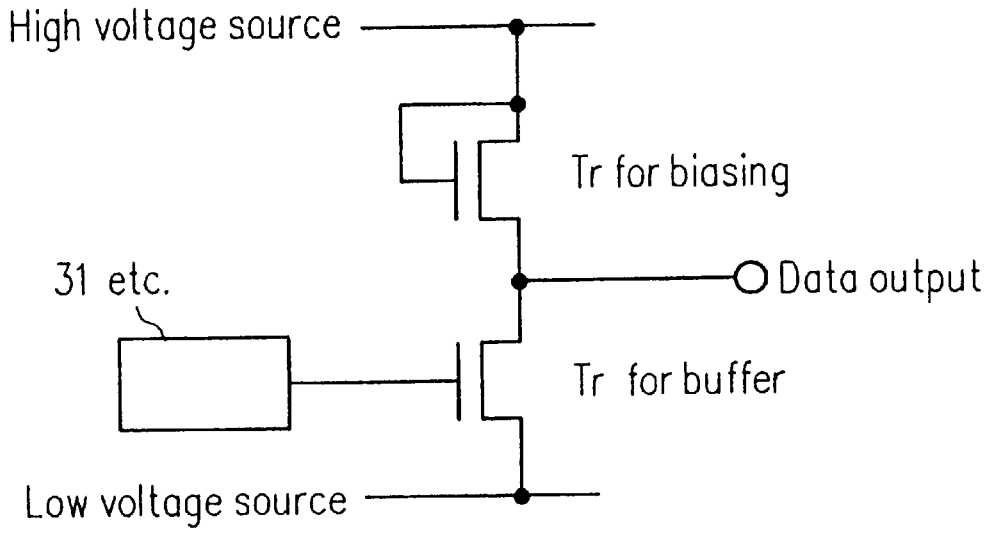
FIG. 2B shows an example of a configuration of the output portion of a data memory element according to the present invention.
Figure 23:
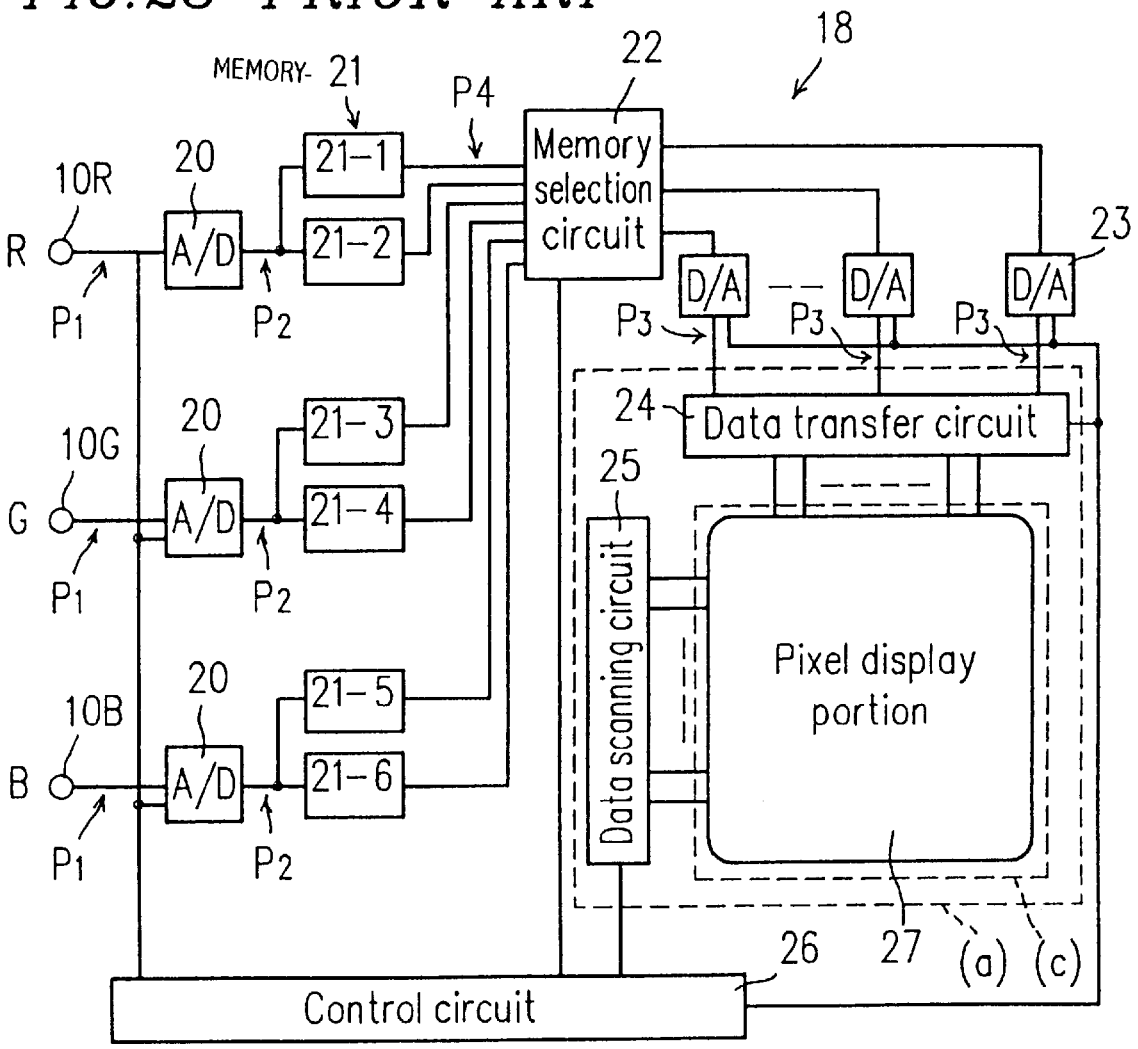
FIG. 23 PRIOR ART
FIG. 23 shows a conventional active matrix liquid crystal display apparatus.
Figure 24:
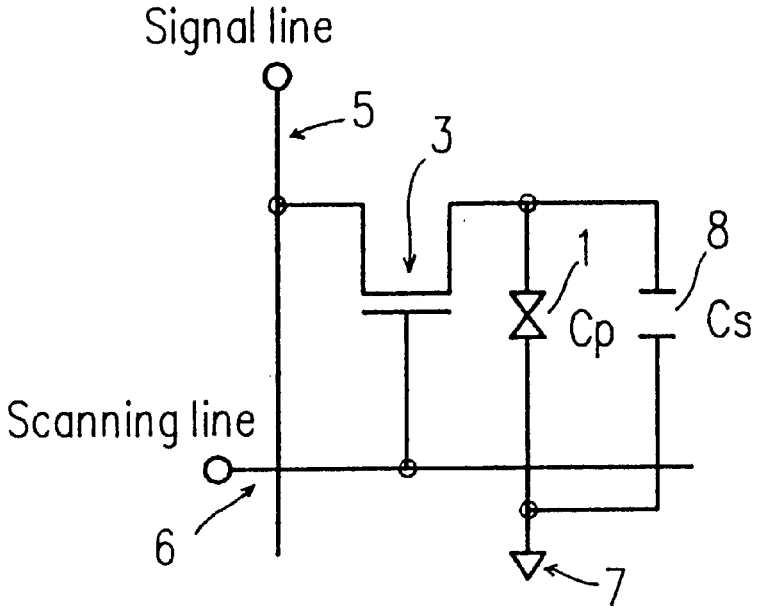
FIG. 24 PRIOR ART
FIG. 24 shows a driving circuit for a pixel portion of a conventional liquid crystal display apparatus.

When a number of wirings are formed on the substrate, the area on the substrate occupied by the wirings increase, resulting in the increase of cross-talk. In the conventional display apparatus 18 shown in FIG. 23, a number of wirings are required for connecting the memory 21 with the memory selection circuit 22. This makes it difficult to form these circuits on the LCD substrate. To solve this problem, the data memory elements 31 to 39 of the memory 30 of this example is designed so that, when the output of each data memory element is off, the impedance of the output terminal thereof should be kept in the open condition (high resistance). For example, the output impedance can be enhanced when the output portion of each of the data memory elements 31 to 39 has a configuration shown in FIG. 2B. By this configuration, it is possible to provide only one common wiring for transmitting signals output from the memory 30 (see FIG. 1). Further, since the selection of a signal to be output from the memory 30 is controlled by the control circuit 80, it is possible to eliminate the memory selection circuit 22, and thus the integration of the circuits can be realized more easily.

Figure 5A:
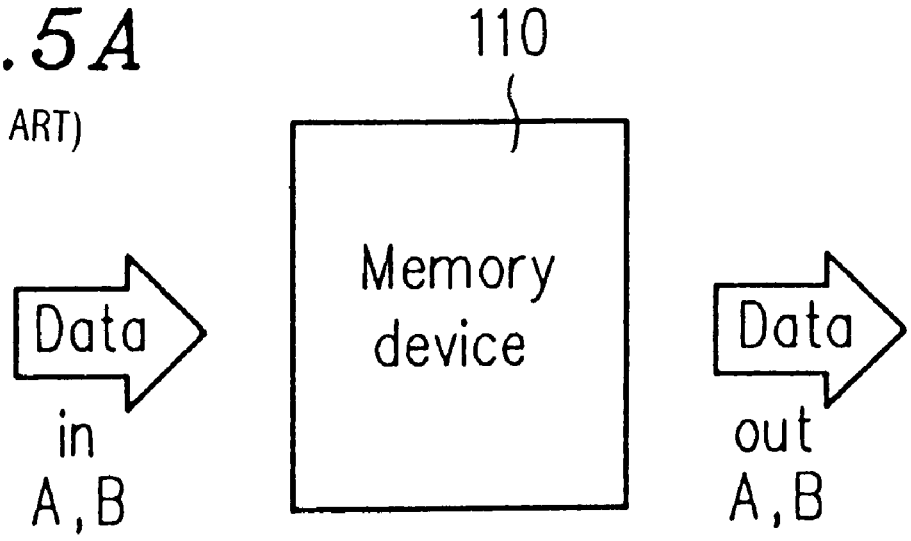
FIG. 5A (PRIOR ART)
FIG. 5A shows input/output of a conventional data memory device.
Figure 5B:
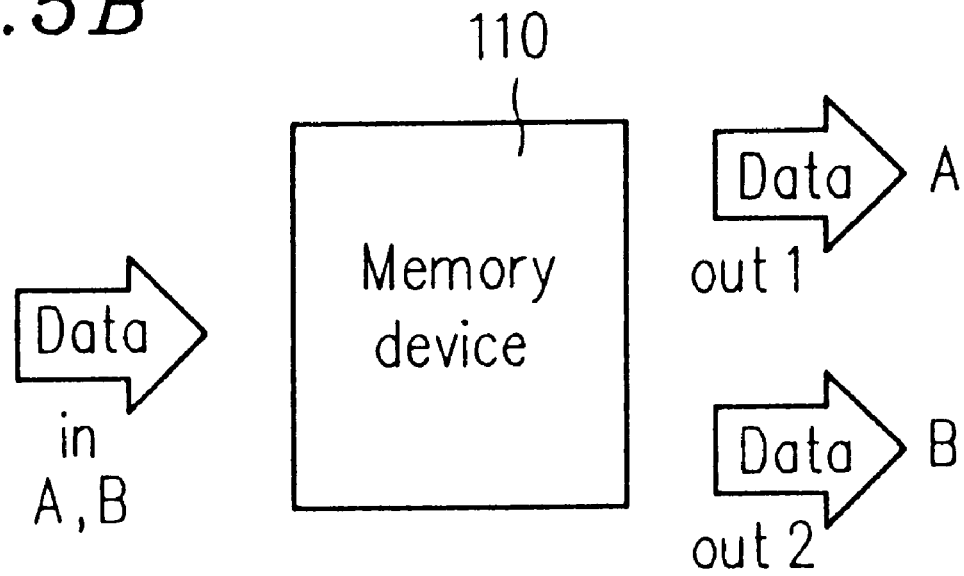
FIG. 5B shows an input/output of a data memory device according to the present invention.

The memory 30 (data memory elements 31 to 39) shown in FIG. 1 will be described. In general, a memory device such as a semiconductor memory has one output for one input as shown in FIG. 5A. When it is required to read information at different points (or periods) on a time axis simultaneously, the memory device should desirably have a plurality of outputs for one input as shown in FIG. 5B. This applies to a memory device which stores data input in series and then outputs the data in parallel if required.

Figure 7:
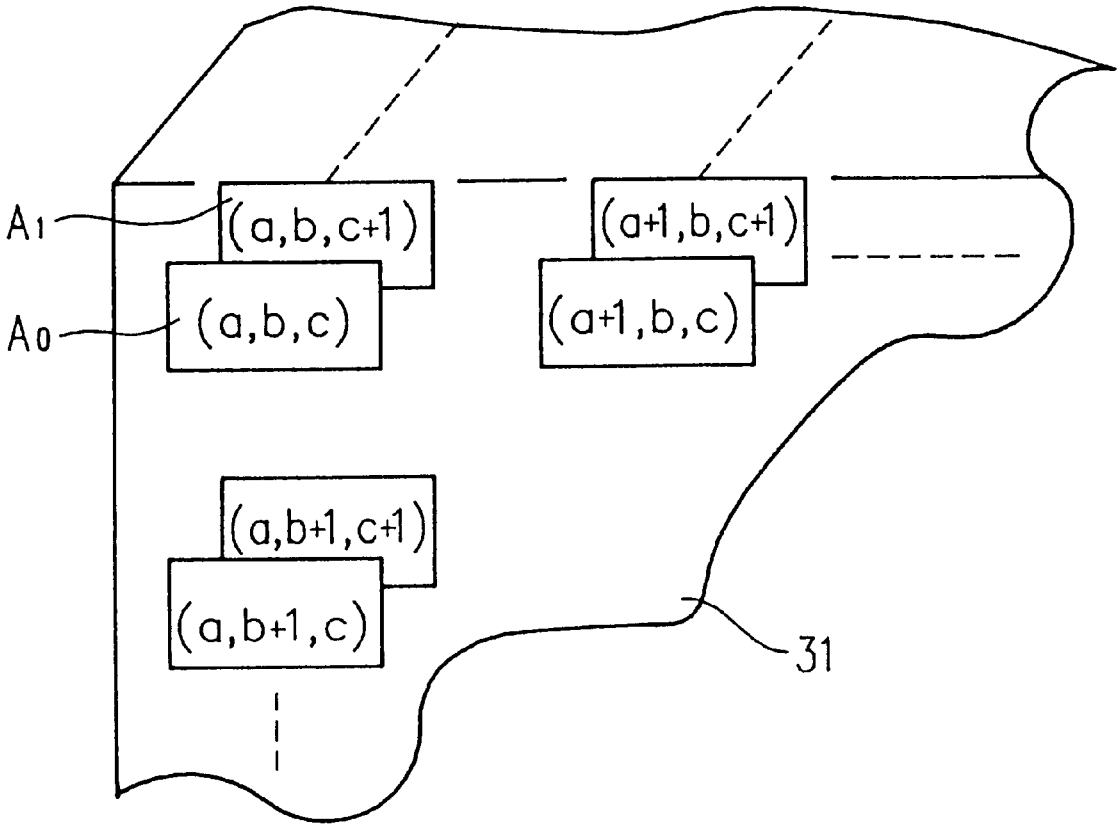
FIG. 7 shows an example of the data storing in a data memory device according to the present invention.

FIG. 7 shows an example of the data memory element 31. Assume that data at time series $A_0, A_1, \ldots$ on the time axis are stored in memory regions (a,b,c), (a,b,c+1), . . . of the memory element 31, respectively. At the reading of these data, data at time series $A_0, A_1, \ldots$ can be read from different output ports of the memory element 31 simultaneously by specifying the data by a memory region (a,b). In other words, all the data stored in the memory regions (a,b,c) to (a,b,c+n) can be read from n+1 different ports simultaneously by specifying the memory region (a,b).

The effects obtained by the image display apparatus 11 of this example will be described. The effects are also applicable to Examples 2 to 4 that will be described later. In the image display apparatus 11 of this example, circuits having various functions are monolithically mounted on one of two substrates included in the image display apparatus. In other words, according to the present invention, part or all of the peripheral circuits such as ICs are monolithically mounted on at least one of two substrates. Such peripheral circuits are conventionally disposed outside the substrate. Further, a data holding element (memory device and the like) is provided in each pixel.

The image display apparatus 11 of the present invention has advantages over the conventional display apparatuses as follows:

1) The Oscillation in Circuits can be Prevented by Optimizing the Circuit Design.

The position, shape, and length of wirings included in an IC are determined by a layout according to the design rule. Therefore, an optimal layout for the wirings can be designed so as to prevent the oscillation in the circuit and thereby to eliminate the unstable operation of the circuit due to the oscillation.

2) The Generation of Noise can be Prevented.

Because the circuits can be monolithically mounted on the IC, the length of circuit wirings can be designed to be as short as possible. This minimizes the action of the circuit wirings as an antenna, and thus makes it possible to design a system which can suppress the generation of noise.

3) The Signal Delay can be Suppressed.

As described above, the length of circuit wirings can be designed to be as short as possible by mounting various circuits on the IC monolithically. The width of the circuit wirings can also be made smaller compared with wirings on a print board. This makes it possible to reduce the generation of the parasitic capacitance at the circuit wirings. The contact capacitance at the contact between the circuit wirings and the IC can also be reduced. Thus, the signal delay caused by the parasitic capacitance can be minimized.

4) The Variation in Display Caused by the Variation in IC Performance can be Prevented.

Since the A/D converter 20, the D/A converter 50, the data transfer circuit 60, and the like are monolithically mounted on the substrate of the image display apparatus, the variation in IC performance caused by different production lots and wafers and thus the variation in display will not occur.

5) The Cost can be Reduced.

The cost of the display portion itself including a pair of substrates increases because various ICs are monolithically mounted on the LCD apparatus. However, the entire cost can be widely reduced compared with that of the conventional display apparatus including all of the peripheral circuits. Further, print boards, wirings on the print boards, and wirings between the print boards required for the conventional display apparatuses are not required. The cost of assembling the print boards is eliminated. Thus, as a whole, a substantial cost reduction can be realized.

6) The Entire LCD Apparatus can be Made Smaller.

A space required for the peripheral circuits is not necessary by mounting the peripheral circuits on the substrate of the LCD apparatus monolithically. This makes it possible to realize a drastically smaller structure of the apparatus. Thus, an electronic apparatus utilizing this thinner and smaller image display apparatus with superior functions can be realized.

EXAMPLE 2

Figure 8:
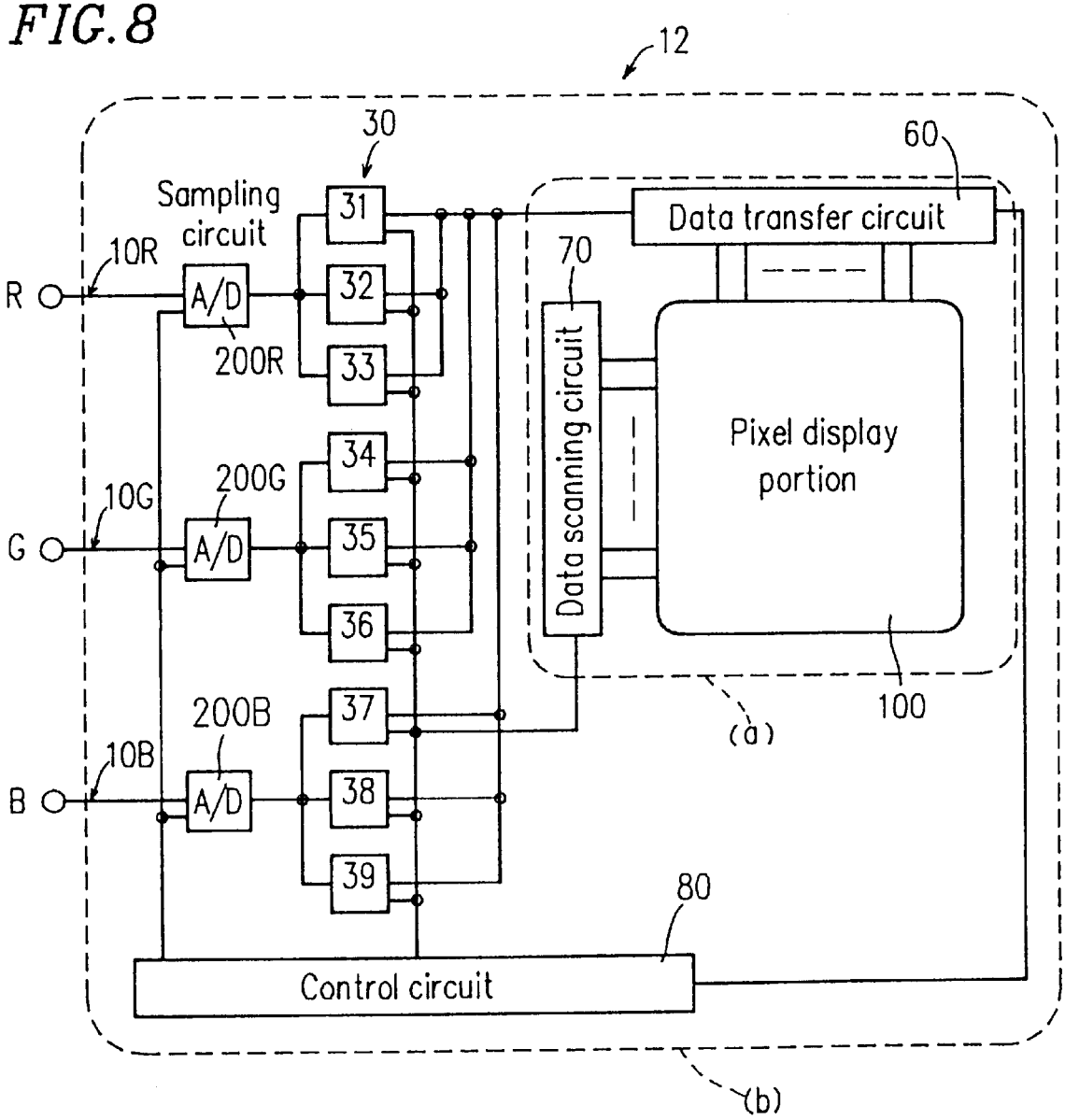
FIG. 8 is a schematic view of a configuration of an image display apparatus of a second example according to the present invention.

FIG. 8 shows an image display apparatus 12 of a second example according to the present invention. The components corresponding to those of the image display apparatus 11 described in Example 1 are denoted by the same reference numerals. The image display apparatus 12 includes neither the A/D converters 20 nor the D/A converter 50 of the image display apparatus 11 in Example 1. Instead, the image display apparatus 12 uses analog video signals input from outside without converting them into digital signals. The analog signals are held in storage means such as capacitors.

In this example, as in Example 1, a video signal is input to the image display apparatus 12 after being divided into a red signal (R), a green signal (G), and a blue signal (B). These color signals for display (color signals) are supplied to the corresponding data input terminals 10R, 10G, and 10B. The input color signals are sampled by corresponding samplers 200R, 200G, and 200B. The sampled color signals are then output to the memory 30.

The memory 30 are composed of nine data memory elements 31 to 39, each storing one field of the input signal. In this example, three data memory elements are allocated for each color signal, and each data memory element includes a capacitor and the like. The memory 30 is connected to the data transfer circuit 60. The data memory elements are controlled by the control circuit 80.

In this example, not only the data transfer circuit 60 and the data scanning circuit 70, but also other peripheral driving circuits (including the samplers 200R, 200G, and 200B, memory 30, and the control circuits 80) are mounted on one substrate on which the pixel display portion 100 is mounted. In other words, the components encircled by a dotted line (b) shown in FIG. 8 are formed on the same substrate together with the components encircled by a dotted line (a). It is not necessary to form all the peripheral components encircled by the dotted line (b) on the same substrate, but at least one of such peripheral components may be formed on the same substrate according to a desired circuit design.

The time-axis modulating circuit 40 is not shown in FIG. 8, but it can be disposed, if required, as in Example 1. The time-axis modulating circuit 40 may be disposed between the memory 30 and the data transfer circuit 60. Alternatively, the expansion along the time axis may be realized by changing the timing at which data is read from the memory 30.

The effects described in Example 1 can also be obtained in this example. Further, since the A/D converters and the D/A converter can be eliminated from the circuit structure of Example 1, it is possible to realize a simpler circuit structure.

EXAMPLE 3

Figure 9:
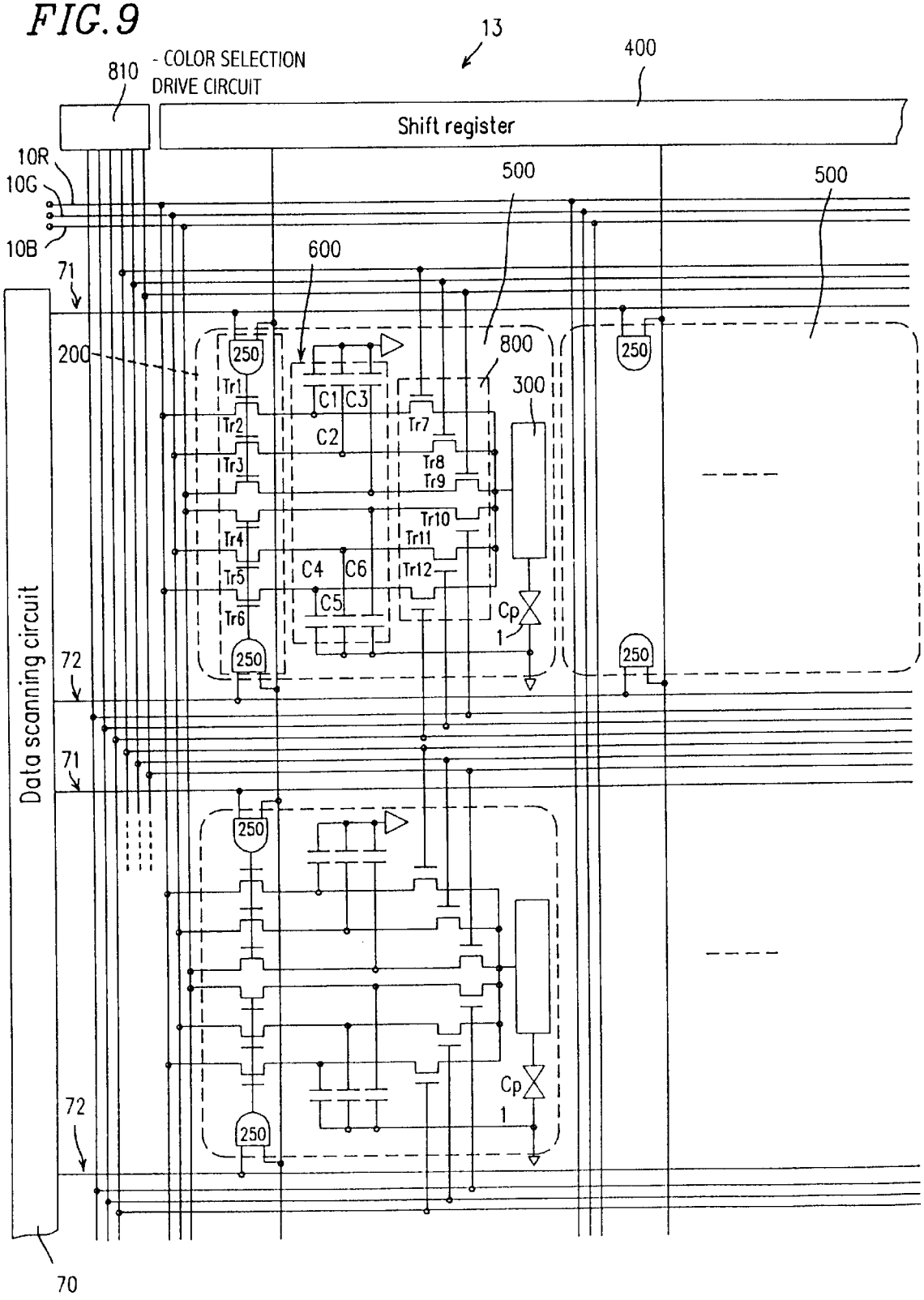
FIG. 9 is a schematic view of a configuration of an image display apparatus of a third example according to the present invention.

FIG. 9 shows an image display apparatus 13 of a third example according to the present invention. The components corresponding to those of the image display apparatuses described in Examples 1 and 2 are denoted by the same reference numerals.

Referring to FIG. 9, as driving circuits disposed on a pixel portion 500, the image display apparatus 13 includes a sampling circuit 200, a data holding circuit 600, a color selection circuit 800, and a data conversion circuit 300 for converting data into display voltage signal. The image display apparatus 13 also includes a data scanning circuit 70, a shift register 400, and a color selection driving circuit 810 for generating a signal for driving the color selection circuit 800.

In this example, as in Examples 1 and 2, a video signal is input to the image display apparatus 13 after being divided into a red (R) signal, a green (G) signal, and a blue (B) signal. These color signals are supplied to corresponding to data input terminals 10R, 10G, and 10B.

The shift register 400 outputs a sampling pulse for a plurality of pixels arranged in the row direction (pixel row). The sampling circuit 200 includes two sets of three transistors Tr1, Tr2, and Tr3 and Tr4, Tr5, and Tr6 and two AND circuits 250. Three color signals input through the data input terminals 10R, 10G, and 10B are supplied to the two sets of three transistors Tr1 to Tr3, and Tr4 to Tr6, respectively. One of the two AND circuits 250 calculates the logical AND of the scanning signal supplied from the data scanning circuit 70 through a scanning line 71 and a signal supplied from the shift register 400. Likewise, the other AND circuit 250 calculates the logical AND of the scanning signal supplied from the data scanning circuit 70 through a scanning line 72 and a signal supplied from the shift register 400. The switching of each set of the transistors Tr1 to Tr3 and Tr4 to Tr6 are controlled by the output of the corresponding AND circuit 250. The data scanning circuit 70 outputs a scanning signal through the scanning lines 71 and 72 alternately.

The data holding circuit 600 includes holding capacitances C1, C2, C3, C4, C5, and C6. These capacitances which are composed of capacitors store charges corresponding to analog signals supplied through the two sets of transistors Tr1 to Tr3 and Tr4 to Tr6. The color selection circuit 800 includes transistors Tr7, Tr8, Tr9, Tr10, Tr11, and Tr12. The switching of these transistors is controlled by a control signal supplied by the color selection driving circuit 810. When a single crystalline silicon substrate is used, these transistors are MOSFET. The output terminals of the transistors Tr7 to Tr12 are connected to the data conversion circuit 300.

The data conversion circuit 300 may be disposed outside the pixel portion 500, or both outside and inside the pixel portion 500.

Figure 10:
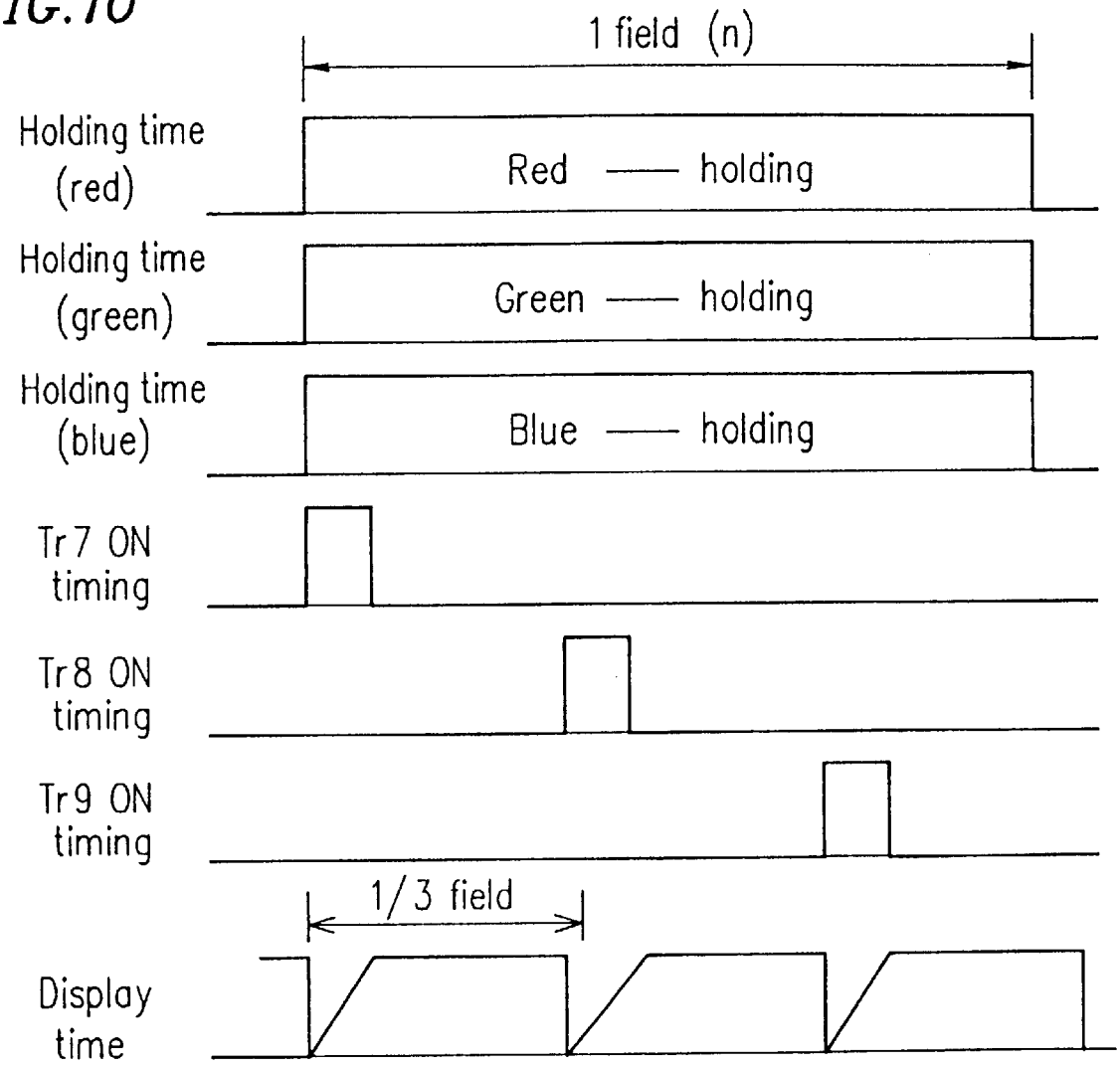
FIG. 10 is a timing chart showing the display operation of the image display apparatus of the third example.

Referring to FIGS. 9 and 10, the operation of the image display apparatus 13 of this example will be described in detail.

When color signals $R_n$, $G_n$, and $B_n$ in the n-th TV field are input to the image display apparatus 13 through the data input terminals 10R, 10G, and 10B, the scanning lines 71 arranged alternately with the scanning lines 72 are activated at a vertical period so as to allow scanning signals to be supplied sequentially therethrough. The shift register 400 supplies pulses sequentially in a horizontal direction at a horizontal period. The transistors Tr1, Tr2, and Tr3 in the sampling circuit 200 corresponding to the scanning lines 71 are turned on through the AND circuit 250, allowing the sampling of the color signals $R_n$, $G_n$, and $B_n$. The sampled color signals are held in the holding capacitances C1 to C3 in the data holding circuit 600.

The above operation is repeated until the last scanning line is scanned, so that all data in the n-th TV field are stored in the holding capacitances C1 to C3. Then, the scanning lines 72 are sequentially activated so that color signals in the (n+1)th TV field are stored in the holding capacitances C4 to C6 in the data holding circuit 600.

While the data in the (n+1)th TV field are being written on the holding capacitances C4 to C6, color selection signal lines are selectively activated by the color selection driving circuit 810. By this selective activation, the transistors Tr7, Tr8, and Tr9 in the color selection circuit 800 are sequentially turned on by every ⅓ TV field (see FIG. 10), allowing the color signals in the n-th TV field held in the holding capacitances C1 to C3 to be output to the data conversion circuit 300.

When the image display apparatus 13 is an LCD apparatus, the data conversion circuit 300 preferably has a function of inverting the polarity of a signal output therefrom, so as to drive the liquid crystal by the alternating voltage signal. The color signals are converted into voltage signals for display by the data conversion circuit 300, and are sequentially applied to the LC capacitances 1. Each pixel displays the color signals R, G, and B according to the voltage applied to the LC capacitance 1.

Then, the display signals in the (n+1)th TV field sequentially turn on the transistors Tr10, Tr11, and Tr12 while the display data for the (n+2)th TV field are being written on the data holding circuit 600. By this activation, the display data for each color is written on the pixels, allowing a red color image, a green color image, and a blue color image to be sequentially displayed within one TV field period.

In this example, capacitors are used for the data holding circuit 600, and MOS transistors are used for the color selection circuit 800. However, other elements having a function of holding digital signals or analog signals can be used for the data holding circuit 600. Also, other elements having a switching function capable of selecting either one of the red color signal, green color signal, and blue color signal and outputting the selected signal can be used for the color selection circuit 800. The number of elements is not limited to that used in this example.

In this example, the sampling circuit is disposed in the pixel portion. This sampling circuit can also be disposed in image display apparatuses adopting a point sequential scanning system, a linear sequential scanning system, and a scanning system where several lines are scanned simultaneously.

This example has been illustrated as an LCD apparatus. However, it will be easily understood that the present invention can also be applicable to other types of image display apparatuses by modifying the contents of this example according to the characteristics of such image display apparatuses.

Thus, according to the present invention, while data in one TV field is being written in the data holding circuit, data in another TV field can be displayed. This makes it possible to extend the data writing period. As a result, the operation speed of the peripheral circuits, especially the sampling speed can be reduced, allowing the peripheral circuits to be monolithically formed on the same substrate as the pixel display portion.

EXAMPLE 4

In the previous examples, the data memory device (the memory 30 or the data holding circuit 600) was disposed at either the inside or the outside the pixel display portion 100. In Example 4, the data memory device is disposed both inside and outside the pixel display portion 100 separately. With configurations described below, when a separate memory device is required outside the pixel display portion 100, such an outside memory device can be less burdened.

Figure 11A:
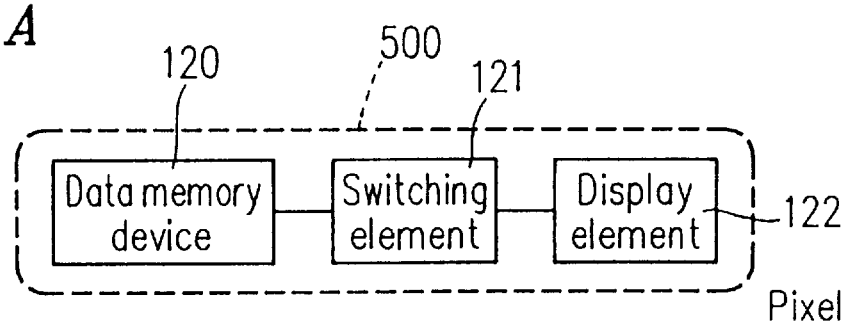
FIGS. 11A to 11C are schematic views showing configurations of data memory devices in the pixel portion of an image display apparatus according to the present invention.
Figure 11B:
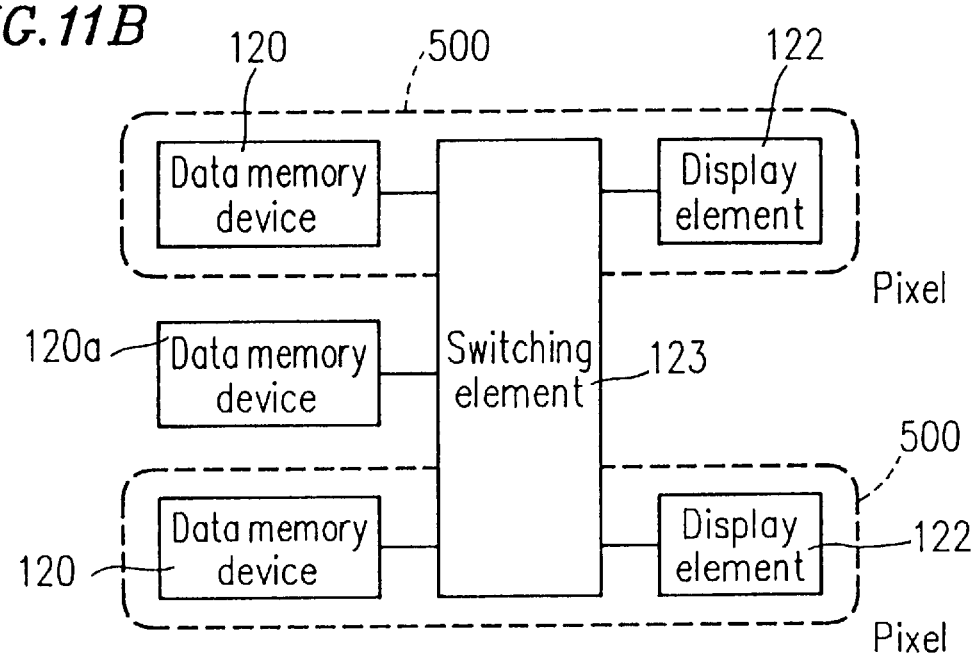
Figure 11C:
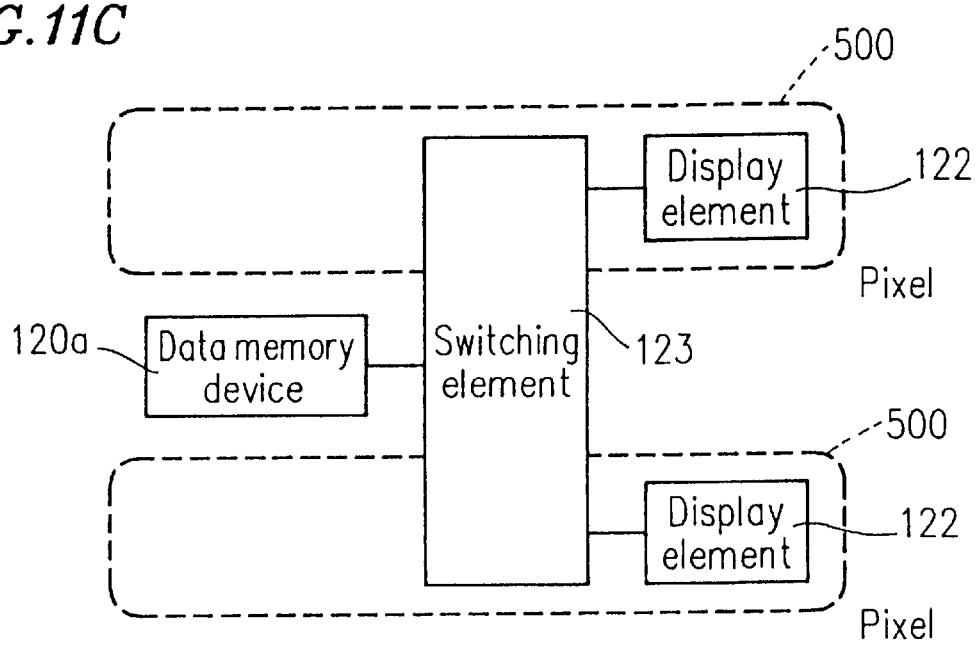

FIGS. 11A to 11C exemplify various configurations of the data memory device according to the present invention. In the previous examples and examples that will be described later, the data memory device may be of any of these configurations or a combination thereof.

A data memory device 120 shown in FIG. 11A is independently disposed on the pixel portion 500. A switching element 121 is formed between the data memory device 120 and a display element 122. The switching element 121 selects one of a red color signal, a green color signal, and a blue color signal stored in the data memory device 120, and outputs the selected signal to the display element 122. The display element 122 conducts a display corresponding to the color signal supplied thereto.

The data memory device shown in FIG. 11B includes the data memory device 120 disposed on each pixel portion 500 and a second data memory device 120*a* disposed on a region outside the pixel portions 500. The second data memory device 120*a* may be jointly used by a plurality of pixel portions 500. The data memory device 120 and the second memory device 120*a* are connected to a common switching element 123. By this switching element 123, the signals stored in the data memory devices 120 and 120*a* are selectively output to the display element 122 for display.

The data memory device 120*a* shown in FIG. 11C is disposed outside the pixel portions 500, and jointly used by a plurality of pixel portions 500. The signal stored in the data memory device 120*a* is selectively output to any one of the display elements 122 on the pixel portions 500 by the switching element 123.

The image display apparatuses described in the above examples will be especially effective when single crystal silicon, sapphire, diamond, or polysilicon is used for the substrates, and thin films are used for the circuit elements.

The present invention has been described as using normal TV signals. However, other signals for display, such as video signals formed by using a computer, can also be used. It will be easily understood that the configurations and the display operations of the above examples may be appropriately changed depending on the following factors: whether the display signal is interlaced or not interlaced; whether it is color or black-and-white; whether or not the pixel display portion 100 has a sufficiently large number of scanning lines required to display the content of one complete TV frame; whether or not some processing is added to data of every frame or every field; whether a signal line used for the transfer of the display signal or digital display data is independently established for each color or shared.

In the above examples, the LCD apparatus has been used to describe the present invention. However, it will be easily understood that the present invention can also be applicable to other types of image display apparatuses by modifying the contents of this example according to the characteristics of such image display apparatuses.

EXAMPLE 5

Figure 12:
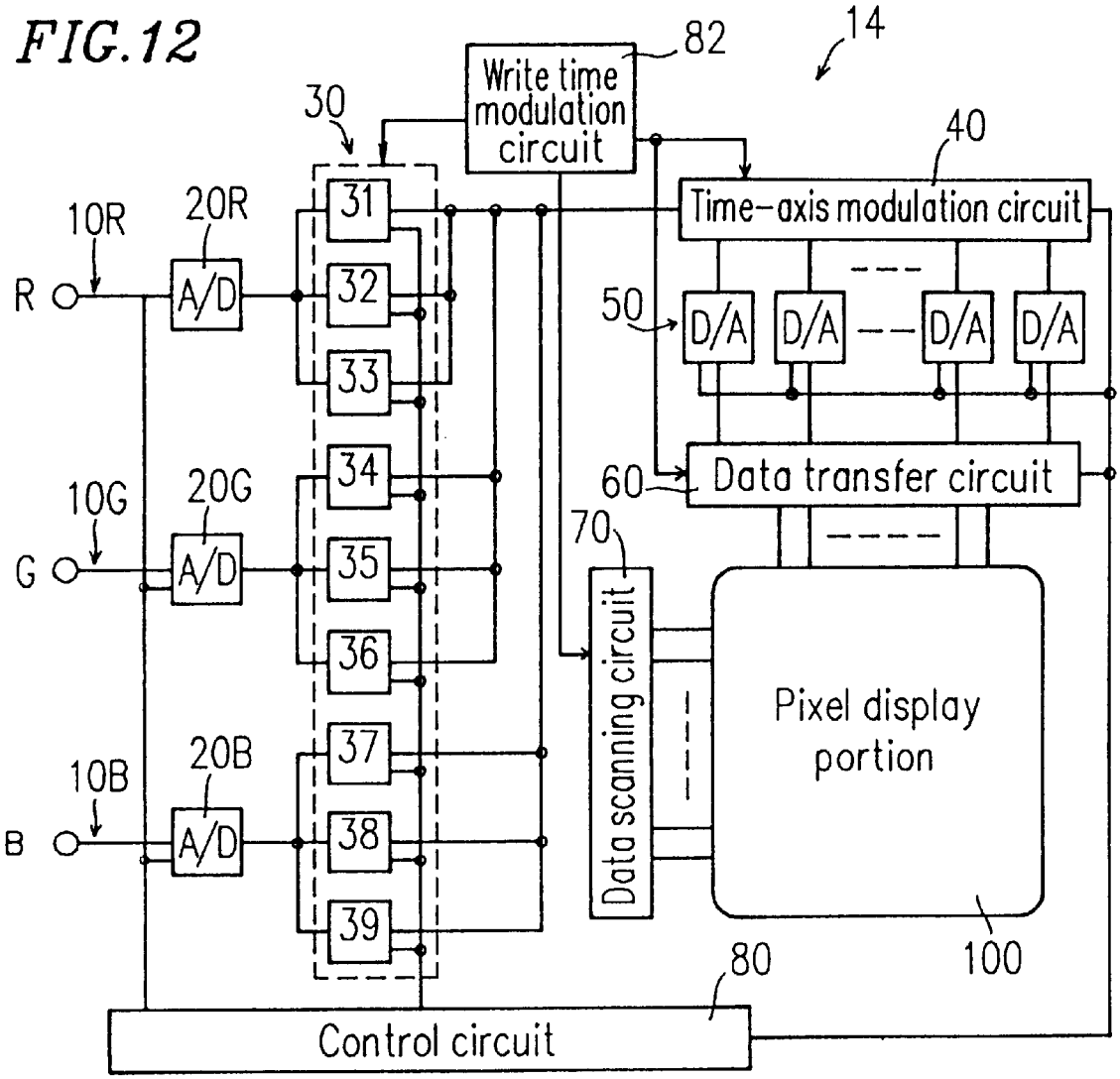
FIG. 12 is a schematic view of a configuration of an image display apparatus of a fifth example according to the present invention.

FIG. 12 schematically shows an image display apparatus 14 of a fifth example according to the present invention. The components corresponding to those of the image display apparatus 11 described in Example 1 are denoted by the same reference numerals. The image display apparatus 14 includes a pixel display portion 100 having a plurality of pixels arranged in a matrix, as in Example 1, and is driven by the field sequential scanning system. The image display apparatus 14 further includes A/D converters 20 composed of A/D conversion element 20R, 20G, and 20B for converting input analog video signals to digital data signals, a memory 30 for storing converted digital data signals so that the data can be separately stored by every field and the data corresponding to one or more fields can be stored at the same time, a time-axis modulation circuit 40 for temporally expanding or compressing the digital data signals received from the memory 30, a D/A converter 50 composed of a plurality of D/A conversion elements for converting the temporally expanded or compressed digital data signals to analog display data, data transfer circuit 60 for transferring the data signals for display to the pixel display portion 100, a data scanning circuit 70 for specifying pixels in which the transferred data signals for display are to be stored among the plurality of pixels of the pixel display portion 100, and a control circuit 80 for controlling the above circuits. The image display apparatus 14 of this example further includes a write time modulation circuit 82 which is connected to the memory 30, the time-axis modulation circuit 40, the data transfer circuit 60, and the data scanning circuit 70.

A video signal is first divided into a red signal (R), a green signal (G), and a blue signal (B), and input to the image display apparatus 14 through data input terminals 10R, 10G, and 10B. The input color analog signals are converted into digital signals by the A/D conversion elements 20R, 20G, and 20B and then output to the memory 30. The operation of the memory 30 is the same as that of the image display apparatus 11 described in Example 1.

The color signals stored in the memory 30 are output to the time-axis modulation circuit 40 under the control of the control circuit 80. The time-axis modulation circuit 40 expands or compresses the color signal supplied from the memory 30 along the time axis. At this time, as described earlier, when each of the data memory elements 31 to 39 of the memory 30 has a plurality of outputs in parallel, each color signal can be further divided into a plurality of signals along the time axis and output in parallel (see FIG. 6). By this operation, each color signal can be further temporally expanded or compressed. The modulated color signal (digital signal) is input to the D/A converter 50 so as to be converted into an analog signal. The D/A converter 50 is composed of a plurality of D/A conversion elements arranged along the row direction of the pixel matrix of the pixel display portion 100. The individual D/A conversion elements correspond to the number of outputs in parallel for each of the data memory elements 31 to 39 of the memory 30. The analog color display signal output from the D/A converter 50 is then supplied to the data transfer circuit 60, which generates a voltage signal for driving the liquid crystal based on the analog color display signal, and supplies the voltage signal to the pixel display portion 100 based on a control signal from the control circuit 80. The write time modulation circuit 82 controls the circuits connected thereto and modulates the transfer time of the display voltage signal supplied to the pixel display portion 100 and the write time of data to the pixels.

The above components may be formed on the same substrate or on different substrates at any combination thereof.

The time-axis modulation of the image display apparatus 14 shown in FIG. 12 is effected by the time-axis modulation circuit 40 disposed between the memory 30 and the D/A conversion circuit 50. Alternatively, the expansion or compression along the time axis may be realized by changing the timing at which data is read from the memory 30. An image is displayed on the pixel display portion 100 in the following manner. The scanning lines are sequentially selected (scanned) by the data scanning circuit 70, so that the voltage signal (display signal) is supplied to pixels connected to the selected scanning line from the data transfer circuit 60.

According to the image display apparatus 14, when an interlaced video signal is input, the display is conducted without interlacing. That is, all the information for one TV frame is displayed on the pixel display portion during one TV field period. In this description, a red color signal in the n-th TV field is denoted by $R_n$, a green color signal in the n-th TV field is denoted by $G_n$, and a blue color signal in the n-th TV field is denoted by $B_n$. Likewise, a red color signal, a green color signal, and a blue color signal in the (n+1)th TV field are denoted by $R_{n+1}$, $G_{n+1}$, and $B_{n+1}$, respectively.

Color signals corresponding to three TV fields, i.e., red color signals $R_n$, $R_{n+1}$, and $R_{n+2}$, green color signals $G_n$, $G_{n+1}$, and $G_{n+2}$, and blue color signals $B_n$, $B_{n+1}$, and $B_{n+2}$, are input to the image display apparatus 14. These analog signals are converted into digital signals by the A/D converter 20, and then input to the memory 30.

The above digital signals are input to the memory 30 after being divided along a horizontal time axis as follows. The color signals $R_n$, $G_n$, and $B_n$ in the n-th TV field are stored in data memory elements 31, 34, and 37. The next color signals $R_{n+1}$, $G_{n+1}$, and $B_{n+1}$ in the (n+1)th TV field are stored in data memory elements 32, 35, and 38. Then, the color signals $R_{n+2}$, $G_{n+2}$, and $B_{n+2}$ in the (n+2)th TV field are stored in data memory elements 33, 36, and 39. While the color signals in the (n+2)th TV field are being written in the memory elements, the color signals in the n-th and (n+1)th TV fields are output and displayed. This means that all information covering one TV frame is output and displayed.

Data of the color signals $R_n$ and $R_{n+}1$ are selected and output from the memory 30 under the control of the control circuit 80. As described earlier, data stored in the memory 30 have been divided along a horizontal time axis (each having ⅓ TV field period). The data selected and output are expanded along the horizontal time axis by the time-axis modulation circuit 40. The temporally expanded data are then converted into analog signals for display by the D/A converter 50. The converted analog signals are input to the data transfer circuit 60, and then supplied to each pixel as voltage signals for driving the liquid crystal.

Figure 13:
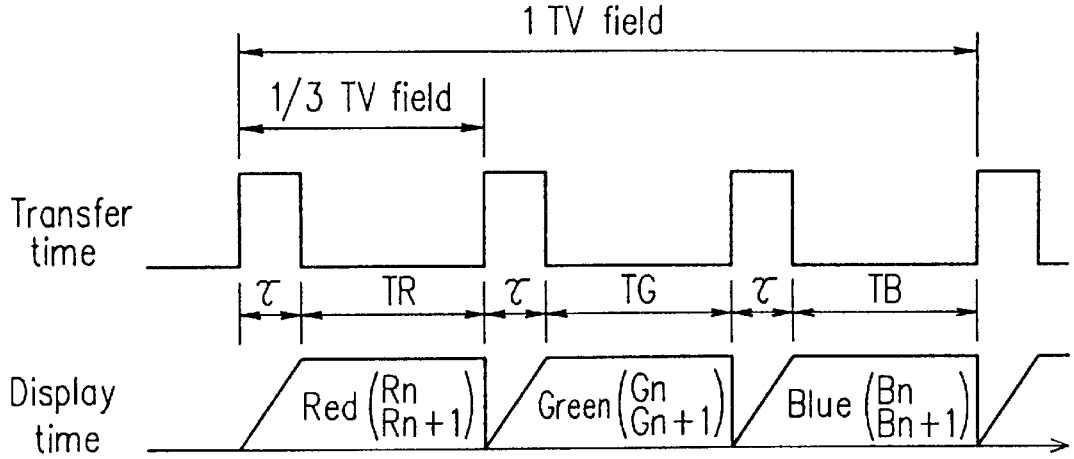
FIG. 13 is a timing chart showing the transfer time and the display time of each color signal transferred by a data transfer circuit of the display apparatus of the fifth example according to the present invention.

FIG. 13 is a timing chart showing the transfer time $\tau$ and display times TR, TG, and TB for the color signals R, G, and B in the n-th and (n+1)th fields transferred by the data transfer circuit 60. The color signals are transferred to the pixel display portion 100 by the data transfer circuit 60 and written on the pixels by the scanning of the data scanning circuit 70.

Since the field sequential scanning is conducted for the three color signals, the display time for one color signal is a ⅓ TV field period. When no means is provided for storing a color signal (data) while another color signal is being displayed, the transfer time $\tau$ of the color signal must be significantly short as shown in FIG. 13. For example, the red color signals $R_n$ and $R_{n+1}$ must be transferred to the pixel display portion 100 within the transfer time $\tau$, and the remaining time is used as the display time TR.

Unlike Example 1, the image display apparatus 14 of this example uses the write time modulation circuit 82 for controlling the data scanning circuit 70, the data transfer circuit 60, and the time-axis modulation circuit 40 at the transfer of the color signals, so that the ON period of at least one scanning line is different from those of other scanning lines. This operation will be described with reference to FIGS. 13 and 14. The data transfer and writing of the red color signal $R_n$ in the n-th field will be described as an example.

At a time $t_0$, the data transfer circuit 60 outputs the red color signal $R_n$ to the pixels connected to the first through the m-th scanning lines (m is the number of the scanning lines). At the same time, the data scanning circuit 70 supplies a scanning signal to the first through the m-th scanning lines, allowing all the scanning lines to be active simultaneously. The scanning lines are kept in the ON state for predetermined ON periods P1 to Pm specifically determined for the respective scanning lines. Data corresponding to the signal voltages are written during these ON periods. The ON period P1 for the first scanning line is determined so that the color signal data can be completely written on the liquid crystal corresponding to the pixels connected to the last m-th scanning line. While the data is written on the pixels connected to the first scanning line, the liquid crystal corresponding to the pixels connected to the m-th scanning line is ready for a change in its alignment in response to the signal voltage applied thereto (i.e., the "rising" of the liquid crystal is complete).

In this example, the ON period of all the scanning lines starts at the time to, and terminates at gradually delaying times $t_1$, $t_2$, . . . , and $t_m$ as the scanning proceeds from the first scanning line toward the m-th scanning line. In other words, the ON periods P1, P2, P3, . . . and Pm for the scanning lines are longer in this order. The rising of the liquid crystal corresponding to all the pixels connected to all the scanning lines starts at the time $t_0$ and is completed during the ON time P1. Accordingly, the liquid crystal at all the pixels connected to all the scanning lines is ready for display in response to the applied signal voltage at and after a time $t_1$ when the ON period P1 has passed from the time $t_0$.

By gradually changing the ON times for the scanning lines, the difference between the rising times of the liquid crystal corresponding to the pixels connected to the first scanning line and at the pixels connected to the m-th scanning line is reduced. As a result, the variation in luminance and the flickering can be minimized. Further, the decrease in brightness due to the reduction of the effective display time can be prevented, and thus the display quality is significantly improved.

Figure 14:
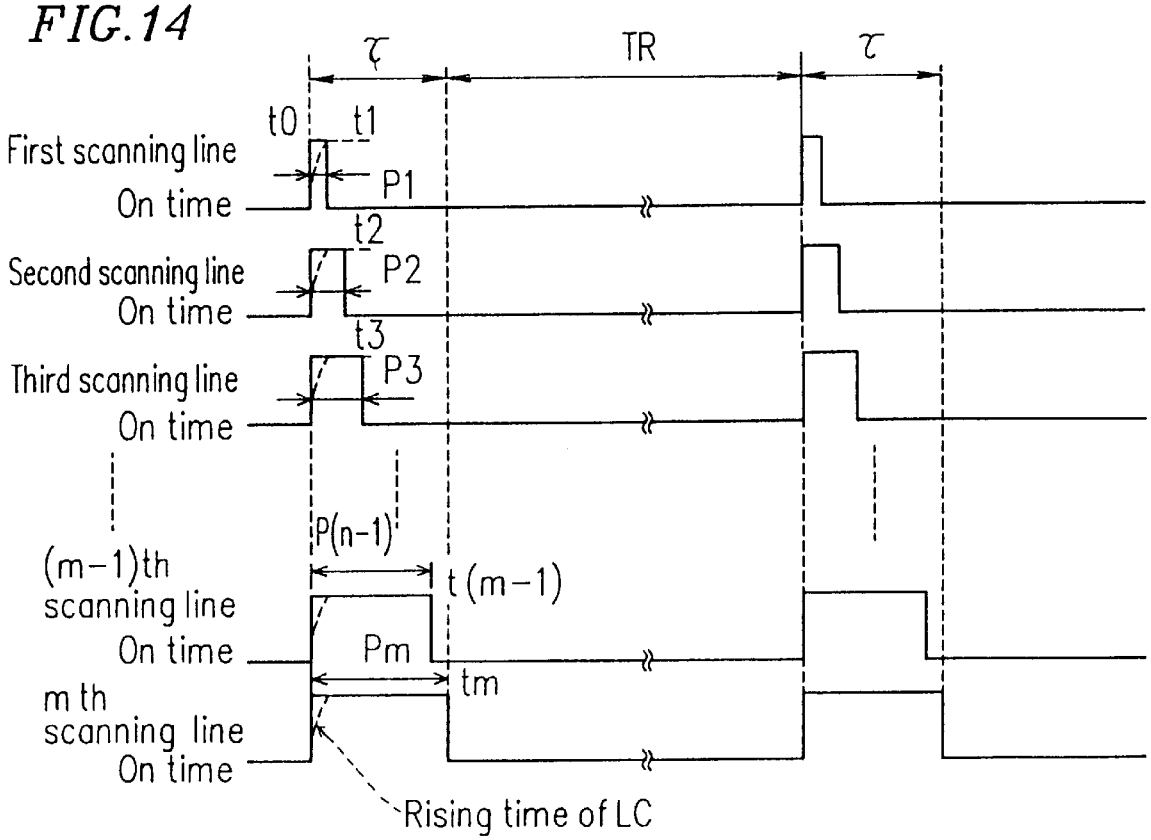
FIG. 14 shows an example of the timing of the write time of display data for an image display apparatus according to the present invention.

The timing at which the scanning signal is supplied by the data scanning circuit 70 is not limited to that shown in FIG. 14 where all the scanning lines are simultaneously activated, but other timing methods can be employed.

Figure 15:
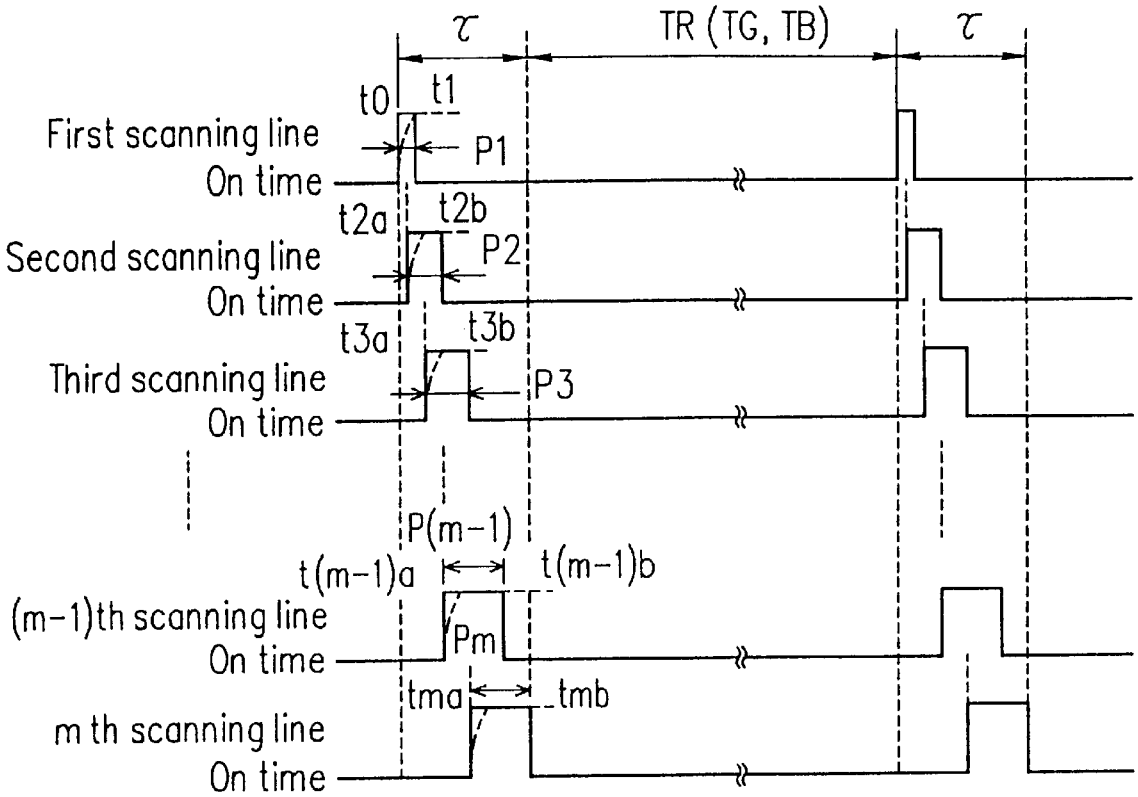
FIG. 15 shows another example of the timing of the write time of display data for an image display apparatus according to the present invention.

FIG. 15 shows the case where the ON periods of the scanning lines are deviated from one another. The ON period for the first scanning line starts at the time $t_0$ and terminates at the time $t_1$ when the ON period P1 has passed. A start time $t_{ia}$ of the ON period for the i-th scanning line (i=2 to m) starts after a start time $t_{(i-1)a}$ for the (i−1)th scanning line and before the end of an ON period P(i−1) starting from the time $t_{(i-1)a}$.

An end time $t_{ib}$ for the i-th scanning line is the time when an ON period Pi for the i-th scanning line has passed from the start time $t_{ia}$. The ON period Pi is determined depending on the scanning lines so that it is longer than the period P1 and gradually longer as the scanning proceeds toward the m-th scanning line.

Figure 16:
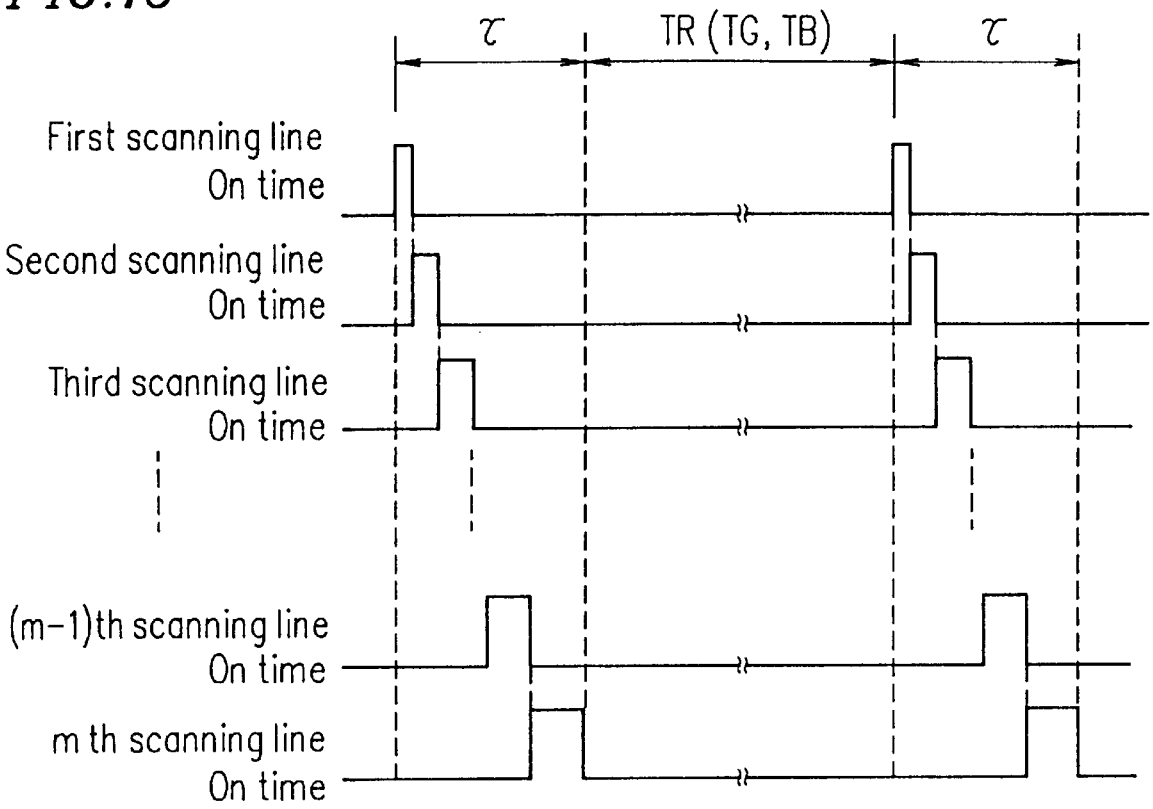
FIG. 16 shows yet another example of the timing of the write time of the display data for an image display apparatus according to the present invention.

In this example, the scanning signal was supplied at the timing when the ON period P(i−1) for the (i−1)th scanning line and the ON period Pi for the i-th scanning line overlap. It is also possible to adopt a timing when the adjacent ON periods P(i−1) and Pi do not overlap as shown in FIG. 16. In the latter case, also, the ON period Pi (i=1 to m) is determined so as to be longer as the scanning proceeds. A combination of the above timings may also be adopted as far as the ON periods for the scanning lines selected later are set longer.

EXAMPLE 6

In Example 5, the write time of data on the pixels has been modulated. In this example, the modulation of the display time for color signals will be described. The display time can be modulated using the write time modulation circuit 82 by changing the transfer time of the color signals depending on the images to be displayed.

Figure 17:
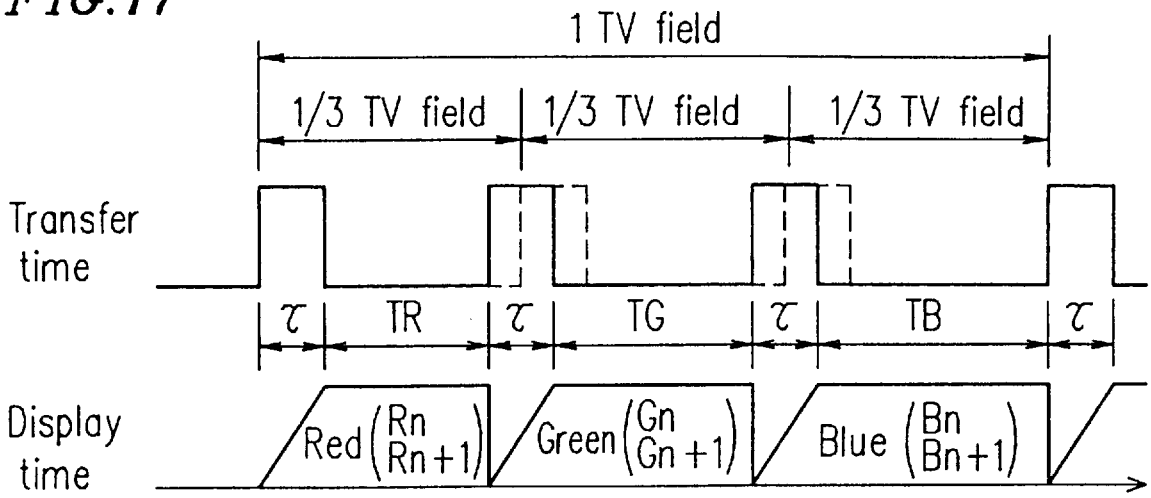
FIG. 17 is a timing chart showing the transfer time and the display time of each color signal transferred by a data transfer circuit of the sixth example according to the present invention.

As shown in FIG. 17, the timing of the transfer time τ may be deviated from the ⅓ TV field. For example, instead of dividing one TV field into three equal portions as shown by the dotted line in FIG. 17, the timing of the transfer time τ may be changed as shown by the solid line. By this deviation in the timing as shown in FIG. 17, the display periods are varied depending on the color signal components displayed on the screen, so that the display time TR for the red color signal is shortest, the display time TG for the green color signal is longer than the display time TR, and the display time TB for the blue color signal is longer than the display time TG.

Because the sense of eyesight is different for different colors, an image displayed on the screen with the same display time for the three primary colors results in lacking natural color tone. By changing the lengths of the display times TR, TG, and TB from one another, this difference in the sense of eyesight for the colors can be compensated. Accordingly, an image with a more natural color tone can be obtained, and the display definition of the image display apparatus can be significantly improved.

Alternatively, the display times may be changed on the basis of the amplitude level of the display signal, rather than the color component of the signal. For example, the display time is shortened for a signal of which variation in amplitude is small and therefore variation in luminance of the resultant image is also small. This is because, when the variation in amplitude is small, it does not take much time for the liquid crystal to respond to the variation in amplitude of the applied signal voltage. Thus, the display time can be shortened when the variation in luminance is small. On the other hand, when the variation in luminance of the image is large, the display time should be extended. Because, it takes much time for the liquid crystal to change the alignment in response to the large variation in amplitude of the signal. Thus, by optimizing the display time according to the response time of the liquid crystal, the effective display time can be extended. This makes it possible to realize a brighter image display, and again the display quality can be significantly improved.

The transfer time τ can be set longer when a memory device and the like are provided on the pixel display portion 100 of the image display apparatus 14 for storing a signal while another signal is displayed. For example, the transfer time τ can be extended for as long as the ⅓ TV field period or even one TV field period.

EXAMPLE 7

The modulation of the transfer time and the display time described in Example 6 can also be obtained when analog video signals input from outside are used without converting them into digital signals and held in a storage means such as a capacitor. In other words, the sampling circuit 200 can be disposed without disposing the A/D converter 20 nor the D/A converter 50.

Figure 18:
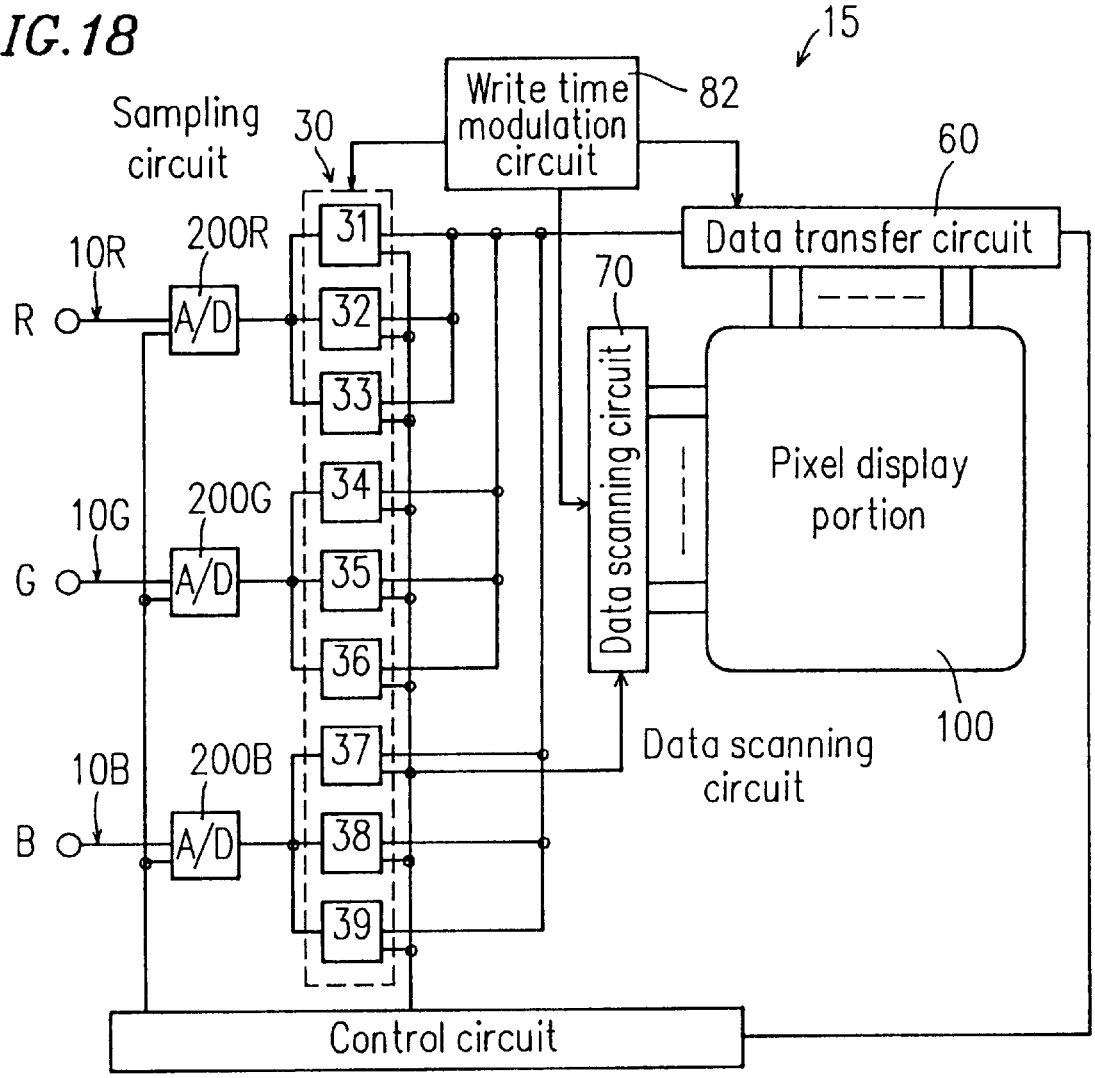
FIG. 18 is a schematic view of a configuration of an image display apparatus of a seventh example according to the present invention.

FIG. 18 shows an image display apparatus 15 of a seventh example according to the present invention. The image display apparatus 15 includes the write time modulation circuit 82 in addition to the components identical to those of the image display apparatus 12 described in Example 2. The circuits of the image display apparatus 15 are not necessarily formed on the same substrate. The description on the configuration and the operation of the image display apparatus 15 are omitted herein as they will be fully understood from the descriptions in the previous examples.

EXAMPLE 8

Figure 19:
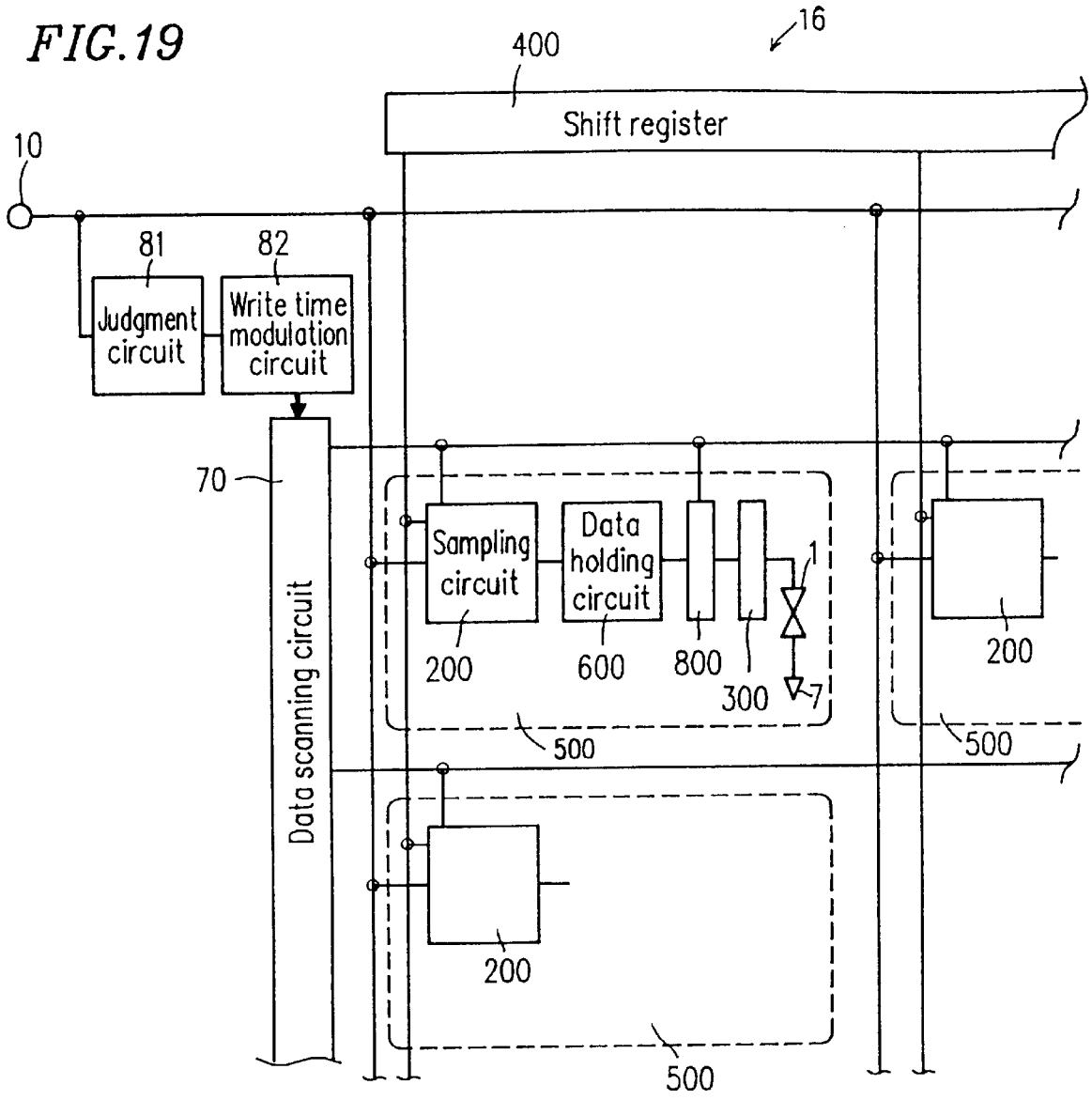
FIG. 19 is a schematic view of a configuration of an image display apparatus of an eighth example according to the present invention.

FIG. 19 shows a block diagram of an image display apparatus 19 of an eighth example according to the present invention. The components corresponding to those of the image display apparatuses in the previous examples are denoted by the same reference numerals. In this example, a sampling circuit 200 for sampling video signals are disposed on each pixel portion 500 of the pixel display portion 100.

As shown in FIG. 19, the image display apparatus 16 includes a data scanning circuit 70, a shift register 400, a judgment circuit 81, and a write time modulation circuit 82. The image display apparatus 16 also includes, as driving circuits on the pixel portions 500, a sampling circuit 200, a data holding circuit 600, a color selection circuit 800, and a data conversion circuit 300. Though only an LC capacitance 1 is connected to a pixel electrode 7 in FIG. 19, an auxiliary capacitance 8 as described above may also be connected to the pixel electrode 7, if required.

The shift register 400 and the data transfer circuit 300 may be disposed outside the pixel portion 500 or both inside and outside the pixel portion 500, if required. Also, though the judgment circuit 81 is disposed upstream of the write time modulation circuit 82 which modulates the write time of the display signal to the LC capacitance 1 in this example, it may also be disposed downstream of the write time modulation circuit 82.

A video signal is input to a data input terminal 10 and transmitted to the data scanning circuit 70 through the judgment circuit 81 and the write time modulation circuit 82. The shift register 400 outputs a sampling pulse for a plurality of pixels arranged in the row direction (pixel row) at a horizontal period for the horizontal scanning. The sampling circuit 200 samples display signals to the pixels at a timing of the sampling pulse supplied from the shift register 400.

The data holding circuit 600 holds the sampled signals for display separately for each color signal for a predetermined time. The color selection circuit 800 selects one of the color signals held by the data holding circuit 600. The data conversion circuit 300 converts the selected color signal into a display signal (voltage signal). The judgment circuit 81 determines the write time based on the information on the level and the color component of the input video signal. The write time modulation circuit 82 outputs a control signal for modulating the write time based on the determination by the judgment circuit 81.

The data scanning circuit 70 of this example has functions as a control circuit for controlling the sampling circuit 200 and the color selection circuit 800, in addition to the function for scanning a plurality of scanning lines, based on the output signal from the write time modulation circuit 82 for modulating the write time to the pixels. Thus, the data scanning circuit 70 may be composed of a sampling control circuit, a color selection control circuit, and a scanning circuit, all of which can individually receive the output signal from the write time modulation circuit 82.

In this example, the modulation of the write time is achieved by changing the timing of the sampling at the sampling circuit 200 by the data scanning circuit 70. Other methods for modulating the write time such as changing the timing of switching of the color selection circuit 800 are also possible.

The operation of the image display apparatus 16 of this example will be described referring to a specific circuit diagram thereof.

Figure 20:
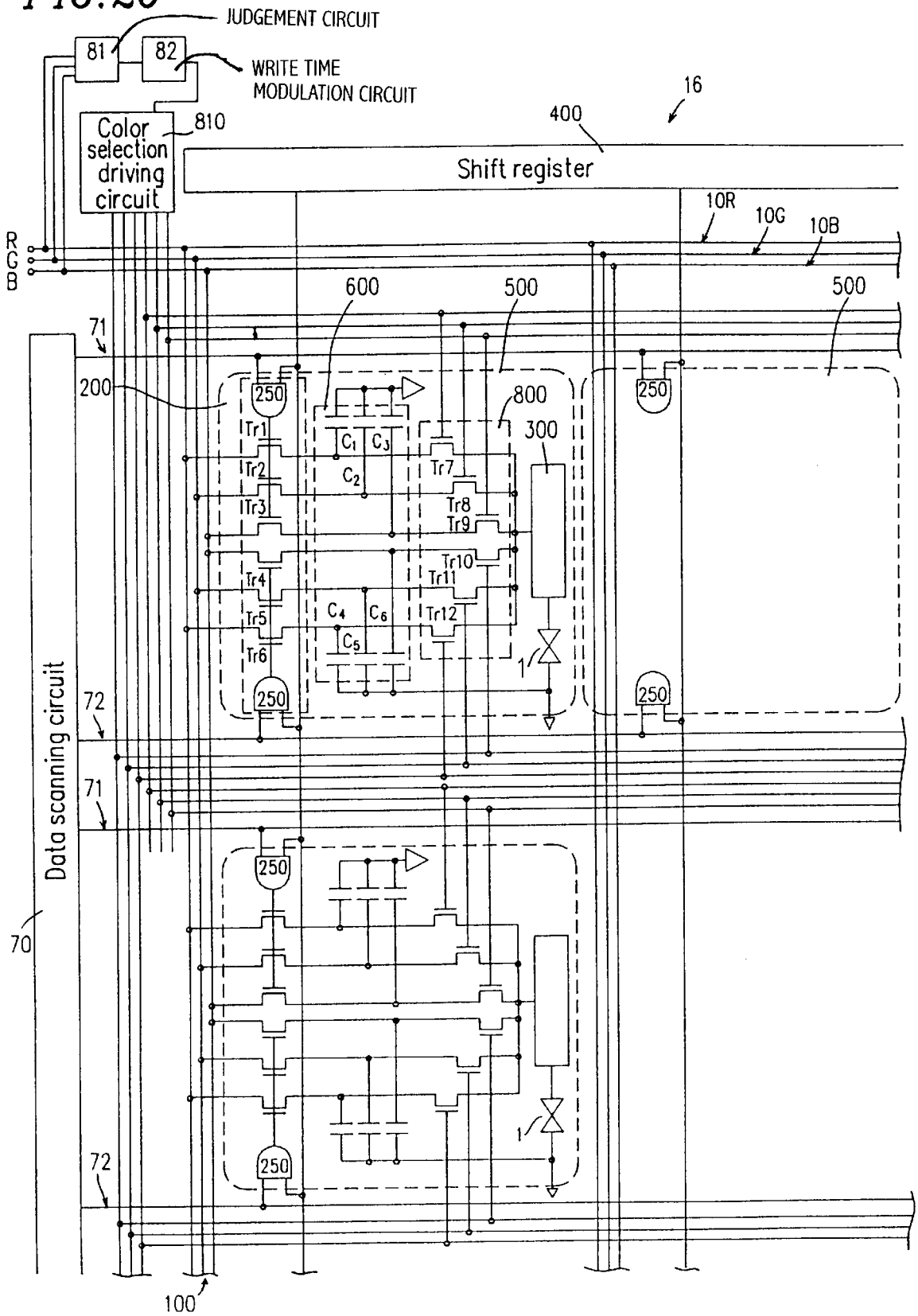
FIG. 20 shows a circuit configuration of a pixel portion and the surrounding circuits of the image display apparatus of FIG. 19.

FIG. 20 shows a concrete circuit configuration of the pixel portion 500 and its peripheral area of the image display apparatus 16.

The image display apparatus 16 includes, as the driving circuits formed on each pixel portion 500, the sampling circuit 200, the data holding circuit 600, the color selection circuit 800, and the data conversion circuit 300 for converting data to a display voltage signal. The image display apparatus 16 also includes, as the peripheral circuits, the data scanning circuit 70, the shift register 400, the judgment circuit 81, the write time modulation circuit 82, and the color selection driving circuit 810.

In this example, as in the previous examples, a video signal is input to the image display apparatus 16 after being divided into a red signal (R), a green signal (G), and a blue signal (B). These color signals are input to corresponding data input terminals 10R, 10G, and 10B.

The input color signals are supplied to the judgment circuit 81 and the sampling circuit 200. The color signals supplied to the judgment circuit 81 is output to the write time modulation circuit 82, and then output to the color selection driving circuit 810 which generates signals for driving the color selection circuit 800. The shift register 400 outputs a sampling pulse for a plurality of pixels arranged in the row direction (pixel row) at a horizontal period for the horizontal scanning.

The sampling circuit 200 includes two sets of three transistors Tr1, Tr2, and Tr3 and Tr4, Tr5, and Tr6 and two AND circuits 250. Three color signals input through the data input terminals 10R, 10G, and 10B are supplied to the two sets of three transistors Tr1 to Tr3, and Tr4 to Tr6, respectively. One of the two AND circuits 250 calculates the logical AND of a scanning signal supplied from the data scanning circuit 70 through a scanning line 71 and a signal supplied from the shift register 400. Likewise, the other AND circuit 250 calculates the logical AND of a scanning signal supplied from the data scanning circuit 70 through a scanning line 72 and a signal supplied from the shift register 400. The switching of each set of the transistors Tr1 to Tr3 and Tr4 to Tr6 are controlled by the output of the corresponding AND circuit 250. The data scanning circuit 70 outputs a scanning signal through the scanning line 71 and 72 alternately.

The data holding circuit 600 includes holding capacitances C1, C2, C3, C4, C5, and C6. These capacitances which are composed of capacitors store charges corresponding to analog signals supplied through the transistors Tr1 to Tr3 and Tr4 to Tr6. The color selection circuit 800 includes transistors Tr7, Tr8, Tr9, Tr10, Tr11 and Tr12. The switching of these transistors is controlled by a control signal supplied from the color selection driving circuit 810. When a single crystalline silicon substrate is used, for example, these transistors are MOSFET. The output terminals of the transistors Tr7 to Tr12 are connected to the data conversion circuit 300.

The data conversion circuit 300 may be disposed outside the pixel portion 500, or may be disposed both outside and inside the pixel portion 500.

Figure 21:
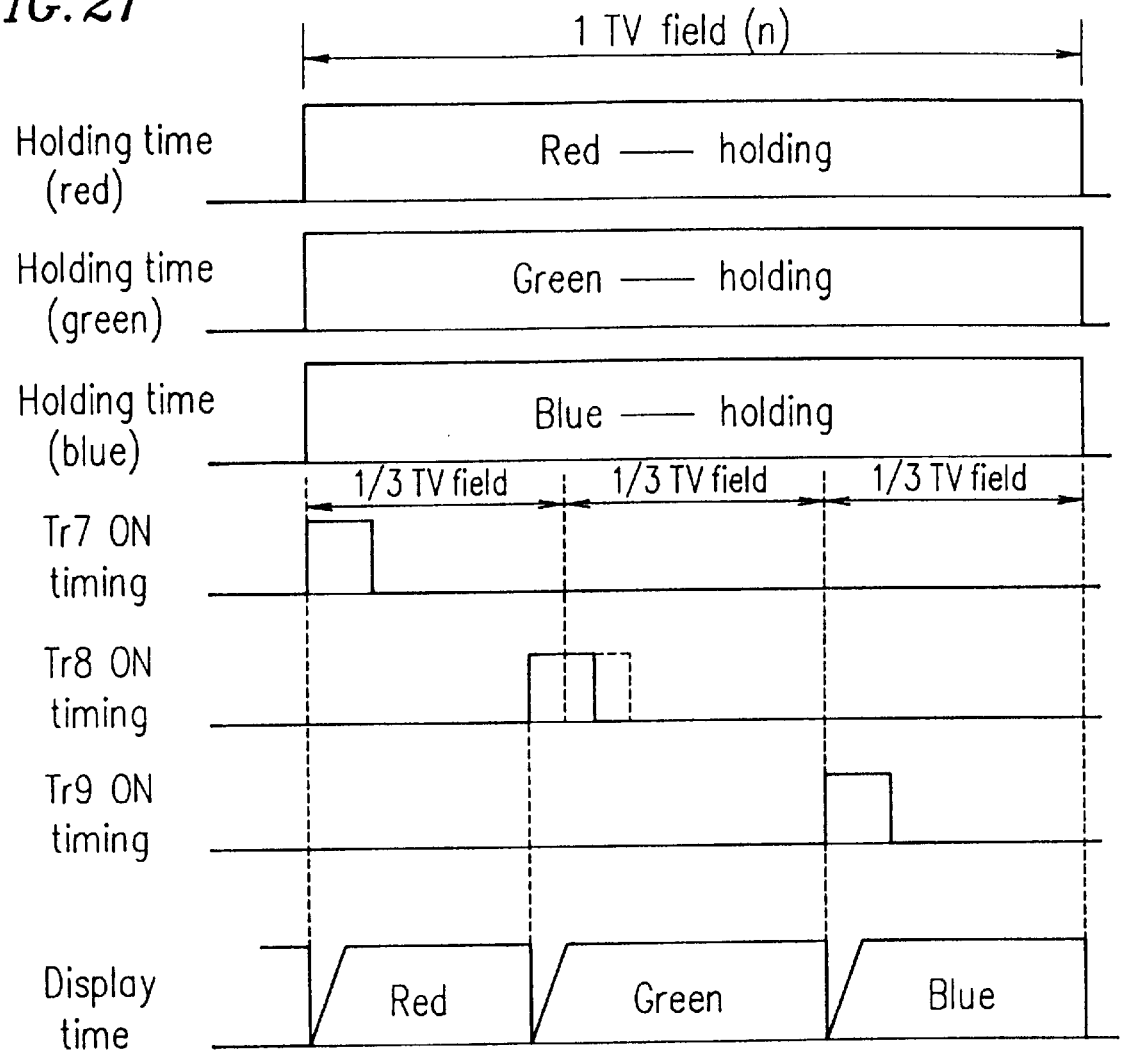
FIG. 21 is a timing chart showing the display operation of the image display apparatus of the eighth example according to the present invention.

Referring to FIGS. 20 and 21, the operation of the image display apparatus 16 of this example will be described in detail.

When color signals $R_n$, $G_n$, and $B_n$ in the n-th TV field are input to the image display apparatus 16 through the data input terminals 10R, 10G, and 10B, the scanning lines 71 arranged alternately with the scanning line 72 are activated at a vertical period to allow scanning signals to be supplied sequentially through the scanning lines 71. The shift register 400 supplies pulses sequentially in the horizontal direction at a horizontal period. The transistors Tr1, Tr2, and Tr3 in the sampling circuit 200 corresponding to the scanning lines 71 are turned on through the AND circuit 250, allowing the sampling of the color signals $R_n$, $G_n$, and $B_n$. The sampled color signals are held in the holding capacitances C1 to C3 in the data holding circuit 600.

The above operation is repeated until the last scanning line is scanned, so that all data in the n-th TV field are stored in the holding capacitances C1 to C3. Then, the scanning lines 72 are sequentially activated so that color signals in the (n+1)th TV field are stored in the holding capacitances C4 to C6 in the data holding circuit 600.

While the data in the (n+1)th TV field are being written on the holding capacitances C4 to C6, color selection signal lines are selectively activated by the color selection driving circuit 810. By this selective activation, the transistors Tr7, Tr8, and Tr9 in the color selection circuit 800 are sequentially turned on by every ⅓ TV field, allowing the color signals in the n-th TV field held in the holding capacitances C1 to C3 to be output to the data conversion circuit 300.

At this time, according to this example, the judgment circuit 81 determines the write time for the signals for display based on the information on the level (luminance) and the color component of the input video signal, and outputs a judgment signal to the write time modulation circuit 82. The judgment of the color component can be achieved by inserting a pulse signal and the like having a different amplitude level, or a different signal width depending on the colors in a blanking period (or a period equivalent to the blanking period) of the input video signal so as to identify the colors.

The write time modulation circuit 82 controls the color selection driving circuit 810 based on the received judgment signal. The ON period of the transistors Tr7, Tr8, and Tr9 in the color selection circuit 800 are modulated under the control of the color selection driving circuit 810 (see FIG. 21).

When the image display apparatus 16 is an LCD apparatus, the data conversion circuit 300 preferably has a function of inverting the polarity of a signal output therefrom, so as to drive the liquid crystal by the alternating voltage signal. The color signals are converted into voltage signals for display by the data conversion circuit 300, and are sequentially applied to the LC capacitances 1. Each pixel displays the color signals R, G, and B according to the voltage applied to the LC capacitance 1.

Then, the display signals in the (n+1)th TV field sequentially turn on the transistors Tr10, Tr11, and Tr12 while the display data in the (n+2)th TV field are being written in the data holding circuit 600. By this activation, the display data for each color is written on the pixels, allowing a red color image, a green color image, and a blue color image to be sequentially displayed within one TV field period.

According to the modulation shown in FIG. 21, the display time for the green color signal is longer than the ⅓ TV field. However, other modulations are also possible. For example, the display time for each color may be shortened than the ⅓ TV field. By this modulation of the display times, it is possible to adjust the luminance of each color and to emphasize or weaken a specified color. Thus, bright and high quality image display with more natural tone can be realized.

Figure 22:
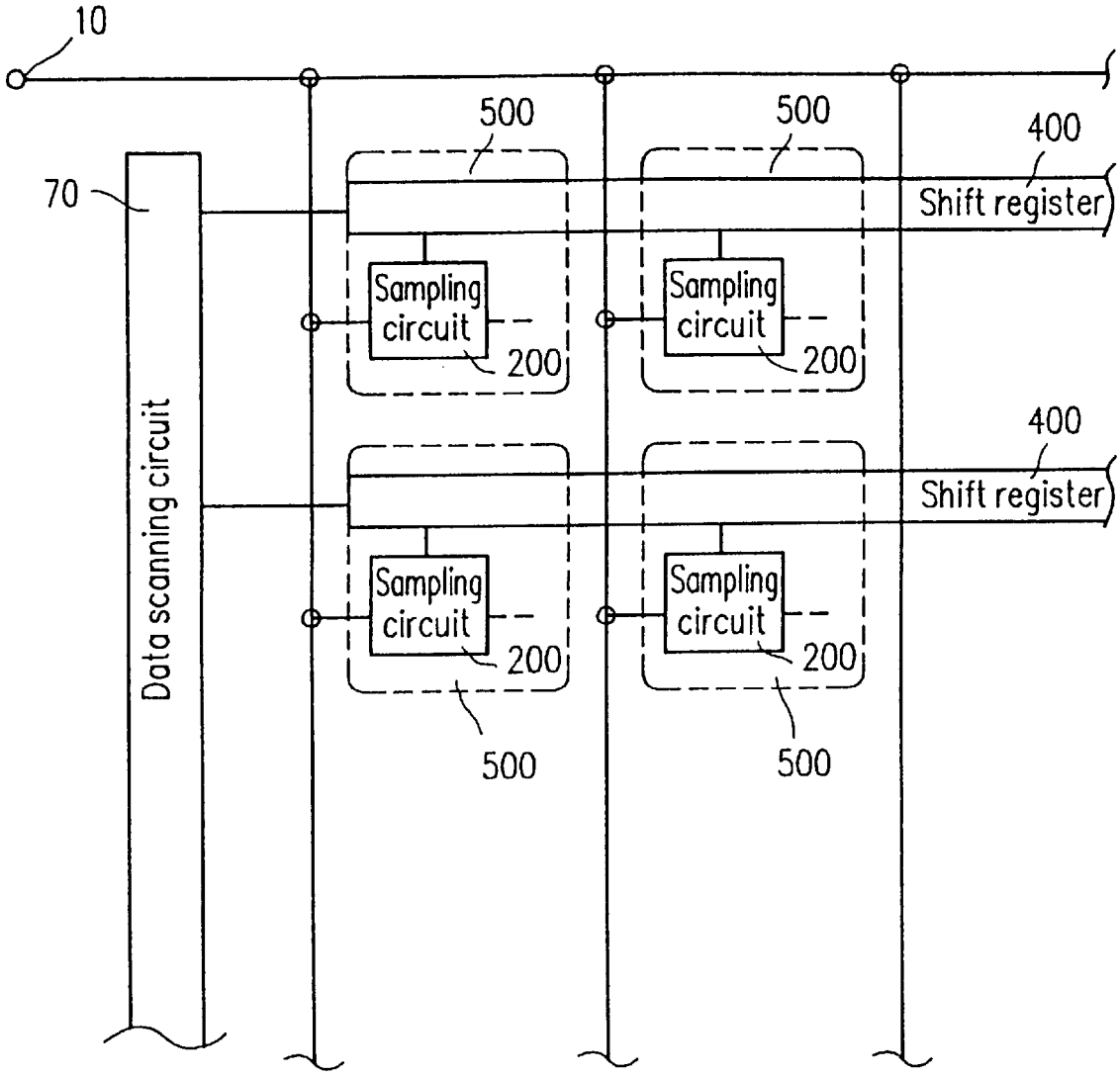
FIG. 22 is a schematic view of another configuration of the image display apparatus of the eighth example according to the present invention.

The configurations of the sampling circuit 200 and the shift register 400 are not limited to those described above. FIG. 22 shows a modification thereof where the shift register 400 is disposed inside the pixel portion 500 for every scanning line. According to this configuration, a scanning signal is input to the shift register 400 from the data scanning circuit 70. As a result, the selection of the scanning line and the sampling at the sampling circuit 200 of the pixel portion 500 connected to the selected scanning line can be conducted in succession.

In this example, capacitors are used for the data holding circuit 600, and MOS transistors are used for the color selection circuit 800. However, other elements having the function of holding either digital signals or analog signals can be used for the data holding circuit 600. Also, other elements having a switching function capable of selecting one of a red color signal, a green color signal, and a blue color signal and outputting the selected signal can be used for the color selection circuit 800. The number of elements is not limited to that used in this example.

In this example, the sampling circuit is disposed in the pixel portion. This sampling circuit can also be disposed in image display apparatuses adopting a point sequential scanning system, a linear sequential scanning system, and a scanning system where several lines are scanned simultaneously.

This example has been illustrated as the LCD apparatus. However, it will be easily understood that the present invention can also be applicable to other types of image display apparatuses by modifying the contents of this example according to the characteristics of such image display apparatuses.

In the above examples, an interlaced video signal was input to the image display apparatuses, but all signals in one TV frame were displayed on the pixel portions without interlacing. The interlaced color signals transferred to the pixels may be interlaced signals without processing or may be obtained by some processing, for example, by some addition or subtraction based on signals in two or more TV fields.

The video signals are not necessarily color signals composed of the three primary colors, but may be two-color signals. The data corresponding to three TV fields (three TV frames in the case of interlacing) are not necessarily stored in the memory 30, but other appropriate numbers of fields may also be used. For example, the memory 30 may store signals corresponding to two TV fields, red color signals $R_n$ and $R_{(n+1)}$, green color signals $G_n$ and $G_{(n+1)}$, and blue color signals $B_n$ and $B_{(n+1)}$.

The data memory elements in the memory 30 are not necessarily completely separated for red color signals, green color signals, and blue color signals. As one modification, one data memory device may be temporally divided so as to be used for all color signals.

As a modification of the scanning method, for interlaced video signals, the same data may be transferred to two scanning lines for conducting alternate scanning between the n-th and (n+1)th TV fields. The two scanning lines to which the same data are transferred may not be scanned simultaneously. The above modifications are applicable to any of the above examples.

In the above examples, it is effective to use single crystal silicon, sapphire, diamond, or polysilicon for the substrates, and the thin films for the circuit elements.

Thus, according to the present invention, in the image display apparatus employing the field sequential scanning system, the appearance of the apparatus can be made significantly compact and the wirings can be simplified by forming the circuits monolithically on the same substrate. Further, the sampling speed can be reduced by forming the data sampling circuits, data memory elements, and the like on pixel portions.

According to the present invention, in the image display apparatus employing the field sequential scanning system, the time allocated to apply a voltage to the liquid crystal can be extended, and the difference between such voltage application times at the first scanning line and at the last scanning line can be reduced. This makes it possible to prevent the screen from becoming dark and to minimize the occurrence of troubles such as the variation in luminance and the flickering. Further, by compensating the difference in the sense of eyesight for colors, natural luminance and color can be obtained.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image display apparatus including display means having a plurality of pixels arranged in a matrix and driven by a field sequential scanning system, the image display apparatus comprising:

analog/digital conversion means for converting an input analog video signal into a digital data signal;

memory means for receiving the digital data signal and storing the digital data signal separately by every field and for one or more fields at the same time;

time-axis modulation means for receiving the digital data signal stored in the memory means and modulating the received digital data signal within its time domain;

digital signal conversion means for converting the digital data signal temporally expanded or compressed into a display data signal;

data transfer means for receiving the display data signal and transferring the display data signal to the display means;

data scanning means for selecting a pixel to which a transferred display data signal is to be supplied among the plurality of pixels of the display means; and control means for controlling the analog/digital conversion means, the memory means, the time-axis modulation means, the digital signal conversion means, the data transfer means, and the data scanning means, so as to effect display of said video signal, wherein each of the pixels includes data holding means for holding a transferred display data signal supplied to a selected pixel, and at least one of the analog/digital conversion means, the memory means, the time-axis modulation means, the digital signal conversion means, and the control means, the data transfer means, the data scanning means, and the data holding means are formed on a same substrate as a pixel.

2. An image display apparatus according to claim 1, wherein the image display apparatus is a liquid crystal display apparatus.

3. An image display apparatus according to claim 1, wherein each of the means formed on the same substrate is formed on a substrate made of a material selected from the group consisting of single crystal silicon, sapphire, diamond, and polysilicon.

4. An image display apparatus according to claim 1, wherein the data holding means temporarily holds the display data signal which is not data-compressed or data-expanded to be displayed in the display means.

5. An image display apparatus including display means having a plurality of pixels arranged in a matrix and driven by a field sequential scanning system, the image display apparatus comprising:

sampling means for sampling an input analog video signal to generate a display data signal;

memory means for receiving the display data signal and storing the display data signal separately by every field and for one or more fields at the same time;

data transfer means for receiving the display data signal stored in the memory means and transferring the display data signal to the display means;

data scanning means for selecting a pixel to which a transferred display data signal is to be supplied among the plurality of pixels of the display means;

control means for controlling the sampling means, the memory means, the data transfer means, and the data scanning means, so as to effect a display of said video signal, wherein each of the pixels includes data holding means for temporarily storing a transferred display data signal, and at least one of the sampling means, the memory means, the control means, the data transfer means, the data scanning means, and the data holding means are formed on a same substrate as a pixel.

6. An image display apparatus according to claim 5, wherein the image display apparatus is a liquid crystal display apparatus.

7. An image display apparatus according to claim 5, wherein each of the means formed on the same substrate is formed on a substrate made of a material selected from the group consisting of a single crystal silicon, sapphire, diamond, and polysilicon.

8. An image display apparatus according to claim 5, wherein the data holding means temporarily holds the display data signal which is not data-compressed or data-expanded to be displayed in the display means.

9. An image display apparatus including display means having a plurality of pixels arranged in a matrix and driven by a field sequential scanning system, the image display apparatus comprising:

switching means for sampling an input analog video signal to provide a display data signal;

data holding means for receiving the display data signal from the switching means and storing the display data signal;

data transfer means for receiving the display data signal stored in the data holding means and transferring the display data signal to a pixel of the display means;

data scanning means for specifying a pixel to which the display data signal is to be supplied among the plurality of pixels of the display means, wherein both the switching means and the data holding means are provided for each of the pixels of the display means, and both the switching means and the data holding means are included as driving circuitry in each pixel.

10. An image display apparatus according to claim 9, wherein the sampling means, the memory means, the data scanning means, and the data holding means are formed on a same substrate as a pixel.

11. An image display apparatus according to claim 10, wherein each of the means formed on the same substrate is formed on a substrate made of a material selected from the group consisting of single crystal silicon, sapphire, diamond, and polysilicon.

12. An image display apparatus according to claim 9, wherein the image display apparatus is a liquid crystal display apparatus.

13. An image display apparatus according to claim 9, wherein the data holding means temporarily holds the display data signal, which is not data-compressed or data-expanded, to be displayed in the display means.

* * * * *